US010206515B1

(12) United States Patent
Jewett et al.

(10) Patent No.: US 10,206,515 B1
(45) Date of Patent: Feb. 19, 2019

(54) POCKETED SPRING ASSEMBLY

(71) Applicant: L&P Property Management Company, South Gate, CA (US)

(72) Inventors: Jason Jewett, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/709,912

(22) Filed: Sep. 20, 2017

(51) Int. Cl.

| | |
|---|---|
| ***A47C 23/04*** | (2006.01) |
| ***A47C 27/00*** | (2006.01) |
| ***A47C 27/07*** | (2006.01) |
| ***A47C 27/05*** | (2006.01) |
| ***A47C 27/06*** | (2006.01) |
| *A47C 23/05* | (2006.01) |

(52) U.S. Cl.
CPC ..... *A47C 27/001* (2013.01); *A47C 27/056* (2013.01); *A47C 27/064* (2013.01); *A47C 27/07* (2013.01); *A47C 23/04* (2013.01); *A47C 23/05* (2013.01)

(58) Field of Classification Search
CPC ..... A47C 27/064; A47C 27/06; A47C 27/063; A47C 27/07; A47C 27/002; A47C 27/045; A47C 27/0453; A47C 27/0456; A47C 27/05; A47C 27/056; A47C 27/065; A47C 27/066; A47C 23/04; A47C 23/05; A47C 23/30; A47C 23/043; B68G 9/00

See application file for complete search history.

(56) References Cited

U.S. PATENT DOCUMENTS

| | | | | |
|---|---|---|---|---|
| 3,626,523 A | | 12/1971 | Robins | |
| 4,234,983 A | * | 11/1980 | Stumpf | A47C 27/064 5/246 |
| 4,451,946 A | * | 6/1984 | Stumpf | A47C 27/064 5/655.8 |
| 4,578,834 A | * | 4/1986 | Stumpf | A47C 27/064 156/291 |
| 5,016,305 A | * | 5/1991 | Suenens | A47C 27/064 5/655.8 |
| 5,048,167 A | * | 9/1991 | Heffley | A47C 27/063 29/402.03 |
| 5,105,488 A | * | 4/1992 | Hutchinson | A47C 23/047 5/614 |
| 5,444,905 A | | 8/1995 | St. Clair | |
| 5,553,443 A | * | 9/1996 | St. Clair | B65B 63/026 53/438 |

(Continued)

FOREIGN PATENT DOCUMENTS

| | | |
|---|---|---|
| EP | 0967031 A2 | 12/1999 |
| JP | 9173673 | 7/1997 |

*Primary Examiner* — Nicholas F Polito
*Assistant Examiner* — Morgan J McClure
(74) *Attorney, Agent, or Firm* — Wood, Herron & Evans, LLP

(57) ABSTRACT

A pocketed spring assembly comprises parallel strings, each string joined to at least one adjacent string. At least some of the strings have pockets of different sizes before springs are inserted therein to accommodate for the fabric stretching due to some of the springs exerting greater force on the fabric than other springs. The ability to create pockets of different sizes enables springs of different strengths to be inserted into the pockets along a string, the string having a generally uniform height after assembly.

22 Claims, 24 Drawing Sheets

(56) References Cited

U.S. PATENT DOCUMENTS 5,740,597 A 4/1998 Eto
5,868,383 A 2/1999 Codos
5,924,681 A * 7/1999 Bullard ..... A47C 27/063 267/89
5,987,678 A 11/1999 Ayers
6,131,892 A * 10/2000 Stumpf ..... A47C 27/064 267/89
6,143,122 A * 11/2000 Mossbeck ..... A47C 27/064 156/291
6,159,319 A * 12/2000 Mossbeck ..... A47C 27/064 156/182
6,170,807 B1 1/2001 Eto
6,176,961 B1 * 1/2001 Mossbeck ..... A47C 27/064 156/291
6,295,676 B1 10/2001 Warner
6,336,305 B1 * 1/2002 Graf ..... B68G 9/00 53/114
6,397,418 B1 * 6/2002 Stjerna ..... A47C 27/062 5/655.8
6,484,338 B1 * 11/2002 Hagglund ..... A47C 27/05 5/654.1
6,591,436 B2 * 7/2003 de Santis ..... B65B 9/073 5/655.8
6,826,796 B1 * 12/2004 Mossbeck ..... A47C 23/0433 5/655.8
6,829,798 B2 * 12/2004 Wells ..... A47C 27/07 5/655.8
6,862,763 B2 3/2005 Mossbeck et al.
7,048,263 B2 * 5/2006 Ahlqvist ..... A47C 27/064 267/91
7,426,810 B2 * 9/2008 Takahashi ..... A47C 23/0433 53/114
7,979,935 B2 * 7/2011 Grothaus ..... A47C 27/064 267/93
8,266,745 B2 * 9/2012 Mossbeck ..... A47C 27/064 5/655.8
8,978,183 B1 * 3/2015 Richmond ..... A47C 27/062 5/655.8
9,314,109 B2 * 4/2016 Saunders ..... A47C 27/04
9,314,110 B2 * 4/2016 Ahlqvist ..... A47C 27/063
9,332,856 B2 * 5/2016 Eigenmann ..... A47C 27/064
9,380,883 B1 7/2016 Mossbeck
10,010,189 B2 7/2018 Eigenmann et al.
2003/0110566 A1 * 6/2003 Stumpf ..... A47C 27/063 5/655.8
2004/0128773 A1 * 7/2004 Barber ..... A47C 27/062 5/716
2005/0257323 A1 * 11/2005 Edling ..... A47C 27/062 5/720
2005/0273939 A1 * 12/2005 Mossbeck ..... A47C 23/047 5/720
2006/0253994 A1 * 11/2006 Spinks ..... A47C 23/0433 5/716
2007/0101507 A1 * 5/2007 Grothaus ..... A47C 27/064 5/716
2007/0124865 A1 * 6/2007 Stjerna ..... A47C 27/063 5/720
2007/0289068 A1 * 12/2007 Edling ..... A47C 27/064 5/720
2008/0109965 A1 * 5/2008 Mossbeck ..... A47C 23/047 5/713
2008/0237948 A1 * 10/2008 Long ..... A47C 23/043 267/95
2010/0011509 A1 * 1/2010 Stjerna ..... A47C 19/04 5/720
2011/0191962 A1 * 8/2011 Frame ..... A47C 27/05 5/717
2015/0359349 A1 * 12/2015 Eigenmann ..... A47C 27/064 5/655.8
2015/0359350 A1 * 12/2015 Eigenmann ..... A47C 27/064 5/652.1
2016/0045034 A1 * 2/2016 Hager ..... A47C 27/064 5/720
2016/0166076 A1 6/2016 Mossbeck
2017/0251821 A1 * 9/2017 Long ..... A47C 27/064
2017/0340130 A1 * 11/2017 Mossbeck ..... A47C 27/066
2017/0354267 A1 * 12/2017 Alletto, Jr. ..... A47C 27/064
2018/0049559 A1 * 2/2018 Jewett ..... A47C 27/062
2018/0055240 A1 * 3/2018 DeMoss ..... A47C 27/062
2018/0168360 A1 * 6/2018 Thomas ..... A47C 23/0435

* cited by examiner

POCKETED SPRING ASSEMBLY

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

Improvements in spring core constructions have involved the use of fabrics, which are thermally or ultrasonically weldable to themselves. One such cost-effective fabric is a spun-bonded polypropylene fabric. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

A pocketed spring assembly may be surrounded with a border made of foam or any other suitable material to provide edge support around the perimeter of the pocketed spring assembly. Such a pocketed spring assembly is mounted upon a base and is completely enclosed within an upholstered covering material. The base and border are known in the industry as a "bucket" into which a pocketed spring assembly may be inserted before the "bucket" is covered with one or more padding or cushioning layers. Upon receiving multiple pocketed spring assemblies, a mattress manufacturer must insert each of the pocketed spring assemblies inside a bucket specifically constructed to receive a specified size of pocketed spring assembly. The mattress manufacturer must construct the foam encasements or "buckets" of different sizes via separate processes, which have proven to be costly due to the labor cost required.

Mattress manufacturers would prefer to eliminate the process of building foam encasements or "buckets" and instead receive a pocketed spring assembly within built-in edge supports along all four sides of the pocketed spring assembly. It is generally known within the bedding industry that edge supports made of pocketed springs are more durable than foam edge supports. Pocketed spring assemblies having pocketed spring edge supports may be roll packed for shipping whereas those having foam edge supports are not easily roll packed for shipping.

Pocketed spring assemblies made by joining parallel strings of individually pocketed springs have been made with four sides of edge support due to pocket coil machines capable of changing the springs within a strand or string of individually pocketed springs. Such modern pocket coil machines may further create posturized pocketed spring assemblies with zones or areas of different firmness.

While modern pocket coil machines may change springs "on the fly", the springs being individually pocketed to create edge support, the cavities into which the different springs are inserted before being closed to create a pocket are the same size. Therefore, the pockets within a string are the same size prior to insertion of the springs regardless of which springs are inserted therein. Because spun-bonded polypropylene fabric used in the strings may stretch, over time, some of the pockets may stretch to a different dimension than other pockets within a string due to different coil springs having different geometries which may exert different degrees of force on the spun-bonded polypropylene fabric of the pockets. This stretching may result in the pocketed spring assembly having an uneven surface which is not desirable.

Coil springs of one region of a pocketed spring assembly which are firmer than coil springs of another region may undesirably create what is referred to in the industry as a "step". For example, coil springs around the perimeter of a pocketed spring assembly which are firmer than the core or interior springs may undesirably create four "steps". A pocketed spring assembly having such a four-sided "step" have displayed the undesirable appearance of sagging towards the middle of the pocketed spring assembly.

Currently, to avoid a "step" or an uneven surface, a mattress manufacturer, for example, may use coil springs less firm than ideal around the perimeter of the pocketed spring assembly and/or coil springs softer than ideal for the center or core of the pocketed spring assembly. Stated differently, a pocketed spring assembly may be manufactured with firmness differential which is less than possible with modern pocket coil machines. The present invention provides a pocketed spring assembly having different zones or regions of desired different firmness without "step". The present invention provides pockets of different dimensions or sizes along a strand or string to accommodate different geometries of the coil springs.

Therefore, there is a need for a pocketed spring assembly lacking any step made of strings with spun-bonded polypropylene fabric which have different zones or regions of different firmness due to different springs within the pockets.

There is further a need for a posturized pocketed spring assembly with a generally smooth upper surface, which when received by a mattress manufacturer, does not require additional edge support to be added, thereby reducing the cost of manufacturing a finished mattress.

SUMMARY OF THE INVENTION

According to one aspect of the invention, a bedding or seating product having four sides of edge support or perimeter edge support is provided. The product comprises a pocketed spring assembly comprising a plurality of parallel strings of springs including exterior strings and interior strings of approximately the same height. Each string is joined to at least one adjacent string in any known manner. In addition, each string may be joined to at least one scrim sheet for stability purposes. Each string comprises first and second opposed plies of fabric and a plurality of pockets formed along the length of the string by transverse or separating seams joining the first and second plies.

At least one spring is positioned in each pocket. Each of the springs has upper and lower end turns and a plurality of central convolutions between the end turns. At least one of the central convolutions may have a barrel diameter greater than the diameters of the other convolutions of the spring. Such a spring is known in the industry as a barrel-shaped coil spring. However, other shaped springs may be used in accordance with the principals of the present invention.

At least some of the pockets of some of the strings are different sizes when empty due to different locations of the longitudinal seams of the pockets, the pockets being approximately the same height with springs therein due, at least in part, to different properties of the springs. Closed pockets within a string may have approximately the same height, but different firmness, due to the properties of the springs within the pockets. Such properties may include out-of-pocket height, gauge of wire, barrel diameter, spring geometry, spring shape, number of central convolutions, wire composition or any combination thereof.

Cushioning materials may be placed on one or both sides of the pocketed spring assembly, and a covering may encase the pocketed spring assembly and cushioning materials.

In any of the embodiments, the strings of springs may extend longitudinally or transversely. A bedding or seating product may be posturized into regions or zones of different firmness by incorporating different strings of springs into the product. In some of the embodiments described herein, a pocketed spring assembly has a firmer perimeter than the interior core of the assembly due to different springs located in the pockets of the strings making the pocketed spring assembly.

In another aspect, a pocketed spring assembly for a bedding or seating product is provided. The pocketed spring assembly comprises interior and exterior parallel strings of springs of approximately the same height. Each string is joined to at least one adjacent string. Each of the strings comprises a plurality of interconnected pockets. Each of the pockets contains at least one spring or other resilient member encased in fabric. The fabric is joined to itself along a longitudinal seam and has first and second opposed plies of fabric on opposite sides of the springs. The fabric of the first and second plies is joined by transverse seams.

At least some of the pockets of the interior strings have different sizes when empty due to different locations of the longitudinal seams of the pockets of the interior strings. The pockets of the interior strings are approximately the same height with springs therein, but of different firmness due, at least in part, to different properties of the pocketed springs. Partially due to the ability of the spun-bonded polypropylene fabric of the pockets to stretch and partially due to the springs having different properties, such as different geometries, the pocketed springs of a string end up having approximately the same height despite springs having different properties being encased in the fabric pockets of the string. In some embodiments, the springs within each of exterior strings have the same properties.

In another aspect, a pocketed spring assembly for a bedding or seating product is provided. The pocketed spring assembly comprises a plurality of parallel strings of springs. Each string is joined to at least one adjacent string. Each of the strings comprises a plurality of interconnected pockets. Each of the pockets contains at least one spring or other resilient member encased in fabric. The fabric is joined to itself along a longitudinal seam and has first and second opposed plies of fabric on opposite sides of the springs. The fabric of the first and second plies is joined by transverse seams.

At least some of the strings contain pockets of different sizes without springs therein due to the location of the longitudinal seams of the pockets. First springs are inside small pockets and second springs are inside large pockets, thereby stretching the fabric of the small pockets to create a string having a generally uniform height and pocketed springs of different firmness. The first springs have different properties than the second springs, such as being made of a heavier gauge or thicker wire, having a greater out-of-pocket height, having a smaller diameter, more convolutions, or any combination thereof.

In another aspect, a string of pocketed springs for a pocketed spring assembly comprises a plurality of interconnected pockets. Each of the pockets contains at least one spring encased in fabric. The fabric is joined to itself along a longitudinal seam and has first and second opposed plies of fabric on opposite sides of the springs, the fabric. The first and second plies are joined by at least one transverse seam between springs. The string has outer pockets and inner pockets between the outer pockets. The outer pockets are smaller than the inner pockets without springs therein. However, the inner and outer pockets are approximately the same size with springs therein due to the properties of the fabric. In another aspect, a string of pocketed springs for a pocketed spring assembly comprises a plurality of interconnected pockets. Each of the pockets contains at least one spring encased in fabric.

The fabric of each pocket is joined to itself along a longitudinal seam. Adjacent pockets are separated by transverse seams. The string has outer pockets and inner pockets between the outer pockets. The outer pockets are smaller than the inner pockets of the interior strings without springs therein due to placement of the longitudinal seams, the inner and outer pockets of the interior strings being approximately the same size with springs therein.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
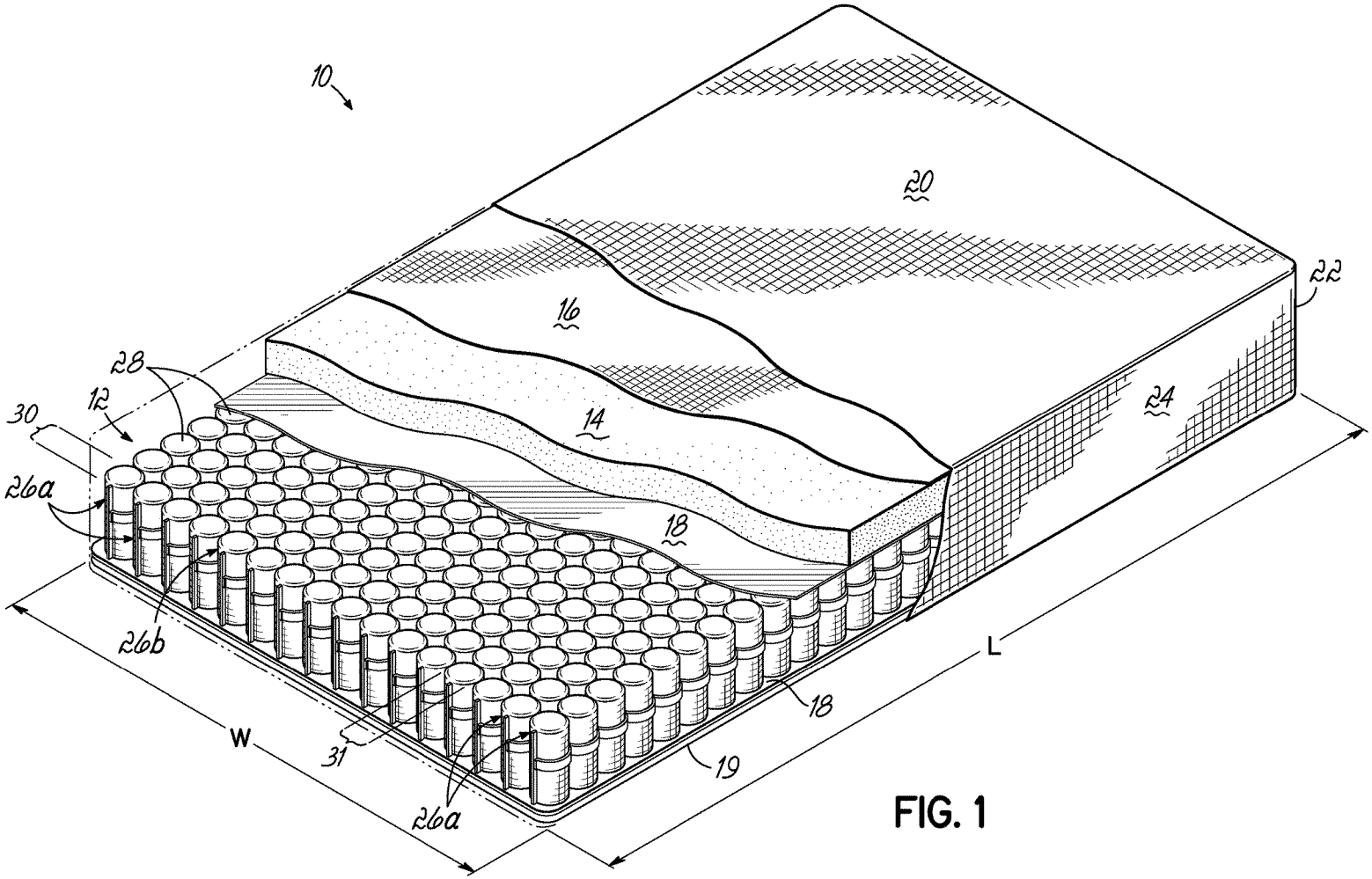
FIG. 1 is a perspective view, partially broken away, of a bedding or seating product incorporating one embodiment of pocketed spring assembly.
Figure 1A:
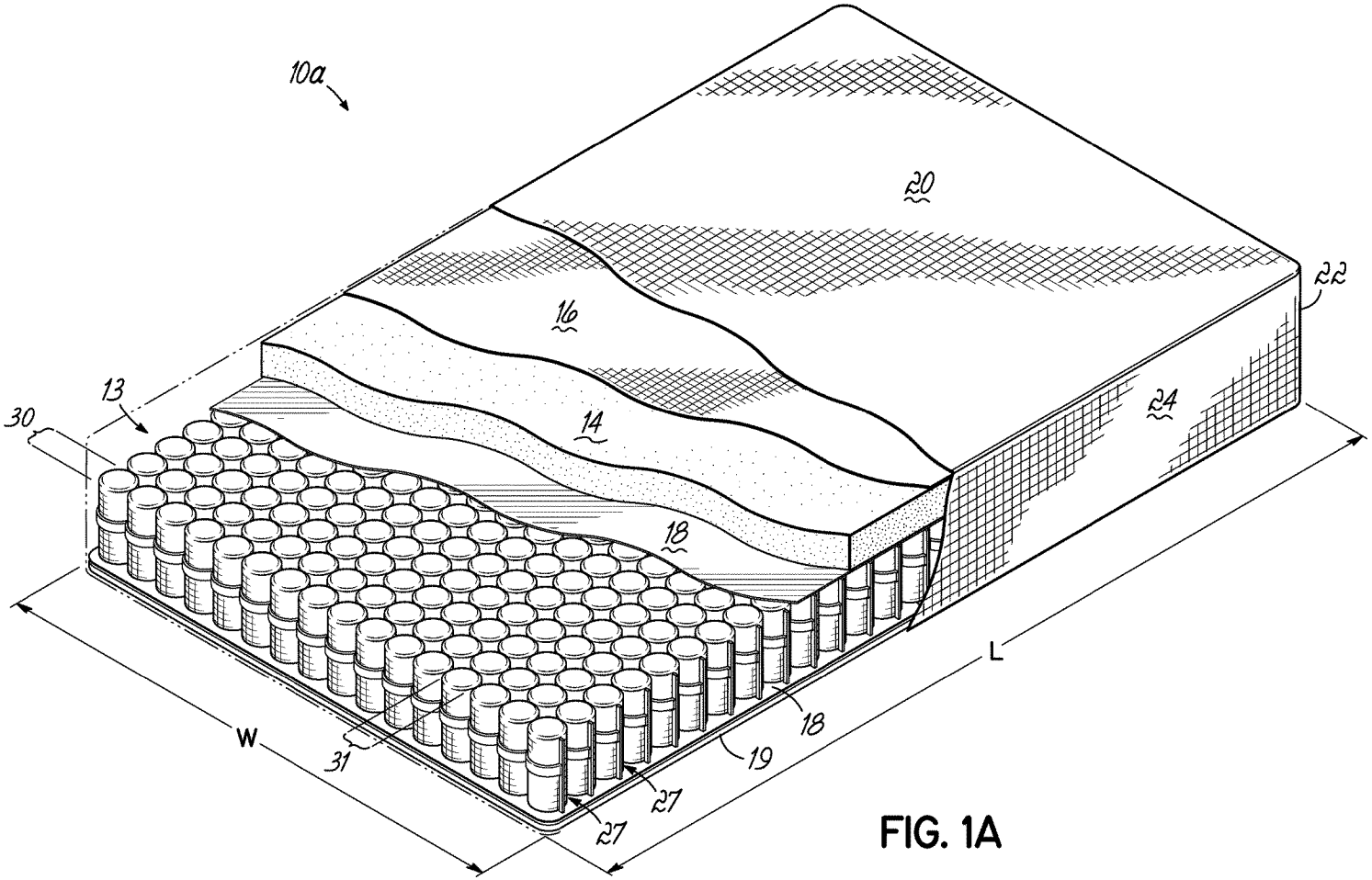
FIG. 1A is a perspective view, partially broken away, of a bedding or seating product incorporating another pocketed spring assembly.

Referring first to FIG. 1, there is illustrated a bedding product in the form of a single-sided mattress 10 incorporating the principles of the present invention. This product or mattress 10 comprises a pocketed spring assembly 12 over the top of which lay conventional padding or cushioning layers 14, 16 which may be foam, fiber, gel, a pocketed spring blanket or any other suitable materials or any combination thereof. Although two cushioning layers 14, 16 are shown in FIGS. 1 and 1A, any number of cushioning layers may be incorporated into the product.

The pocketed spring assembly 12 may include upper and lower scrim sheets 18 attached with adhesive to upper and lower surfaces of the strings of springs 26 of the pocketed spring assembly 12. The lower scrim sheet 18 may be adhesively secured to a base 19 which may be made of foam, fiber or any other desired material. In any of the embodiments shown or described herein, one scrim sheet or both scrim sheets may be omitted. Similarly, in any of the embodiments shown or described herein, the base 19 may be omitted. The pocketed spring assembly 12 and base 19 (if there is one) may be completely enclosed within an upholstered cover 20.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the invention that the length and width may be identical, as in a square product.

As shown in FIG. 1, pocketed spring assembly 12 is manufactured from multiple strings 26*a*, 26*b* of pocketed springs 28 joined together. As described below, strings 26*a* are called exterior strings of pocketed springs, and strings 26*b* are called interior strings of pocketed springs in this document. Each string 26*a*, 26*b* extends longitudinally or from head-to-foot along the full length of the pocketed spring assembly 12.

Although the strings are illustrated as extending longitudinally or from head-to-foot in the pocketed spring assembly 12 of FIG. 1, the strings may extend transversely or from side-to-side as shown in the pocketed spring assembly 13 shown in the product 10*a* shown in FIG. 1A. As shown in FIG. 1A, pocketed spring assembly 13 comprises multiple transversely extending strings 27 of pocketed springs.

Figure 1B:
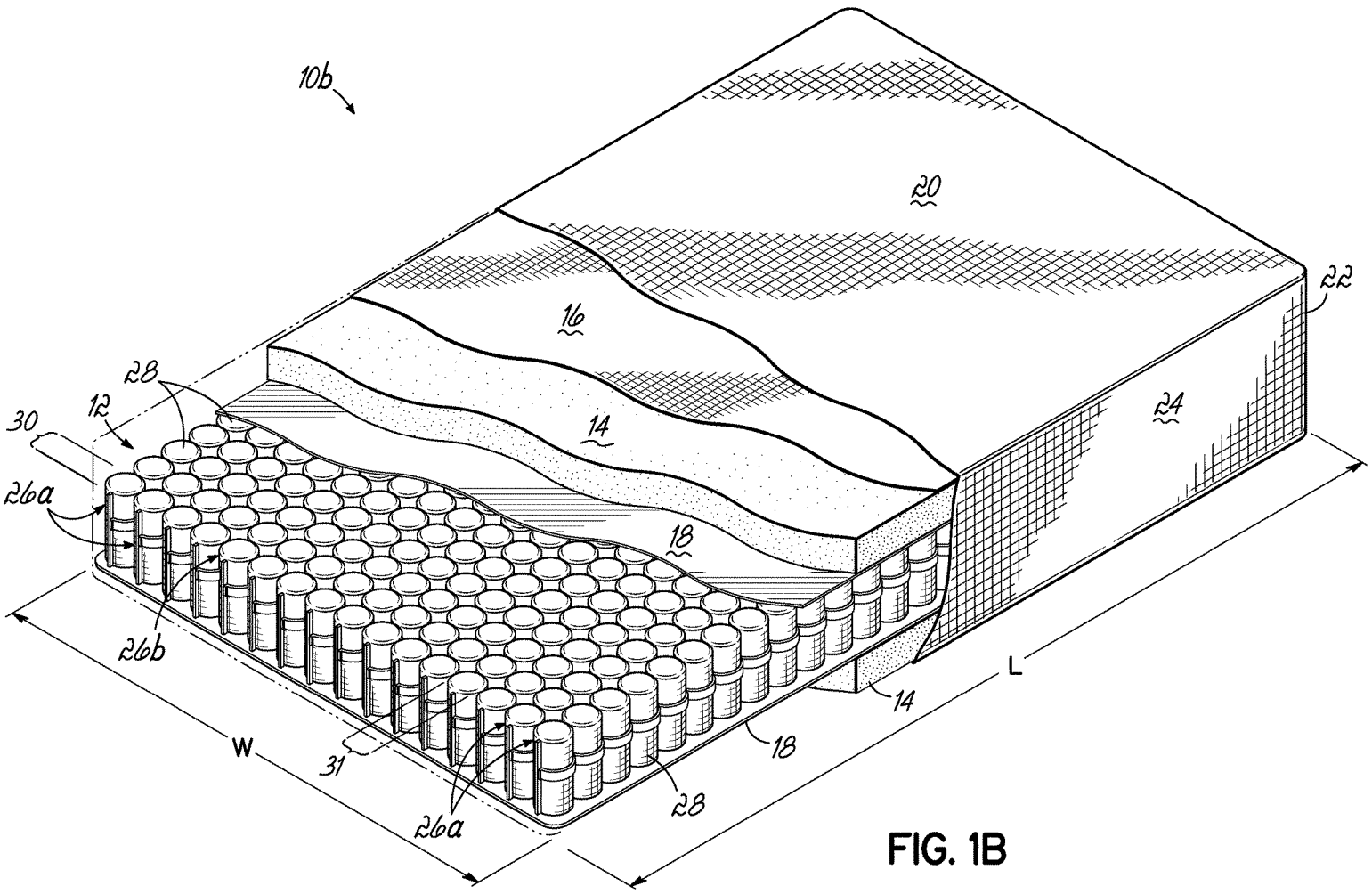
FIG. 1B is a perspective view, partially broken away, of a double-sided bedding product incorporating the pocketed spring assembly of FIG. 1.

FIG. 1B illustrates a double-sided mattress or product 10*b* comprising pocketed spring assembly 12 and scrim sheets 18 identical to those shown in the mattress 10 of FIG. 1. However, mattress 10*b* of FIG. 1B has conventional padding layers 14, 16 above and below the pocketed spring assembly 12. Although two cushioning layers 14, 16 are shown per side, any number of cushioning layers may be incorporated into the product on either side.

As shown in FIG. 1, pocketed spring assembly 12 comprises a plurality of strings 26*a*, 26*b* of pocketed springs extending from head-to-foot or longitudinally. As shown in FIG. 1A, pocketed spring assembly 13 comprises a plurality of strings 27 of pocketed springs extending from side-to-side or transversely. Due to the symmetric nature of the springs inside the strings, any embodiment of pocketed spring assembly shown or described herein may be used in a single-sided and/or a double-sided product.

Any of the padding or cushioning layers may be omitted in any of the embodiments shown or described herein. The novel features reside in the pocketed spring assembly. A pocketed spring assembly in accordance with the invention is not intended to be limited to use in products shown or described herein; but rather may be used in any product.

These strings and any other strings of pocketed springs described or shown herein, may be connected in side-by-side relationship in any manner as, for example, by gluing the sides of the strings together in an assembly machine, to create an assembly or matrix having multiple rows and columns of pocketed springs bound together as by gluing, welding or any other conventional assembly process commonly used to create pocketed spring cores or assemblies. Referring to FIGS. 1 and 1B, the longitudinally extending strings 26*a* and 26*b* may be joined so that the individually pocketed springs are aligned in transversely extending rows 30 and longitudinally extending columns 31. The same is true with transversely extending strings 27 shown in FIG. 1A.

Figure 2:
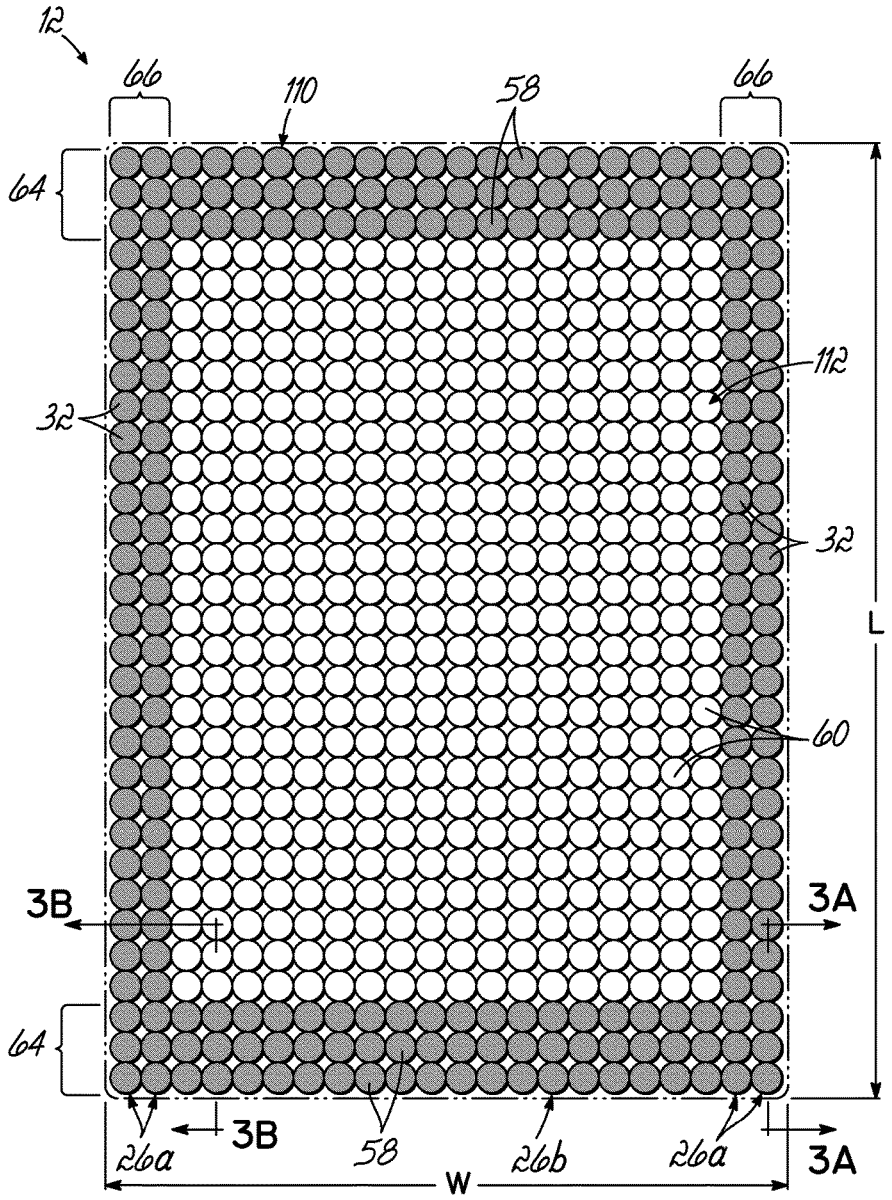
FIG. 2 is a top view of the pocketed spring assembly of FIG. 1.
Figure 3:
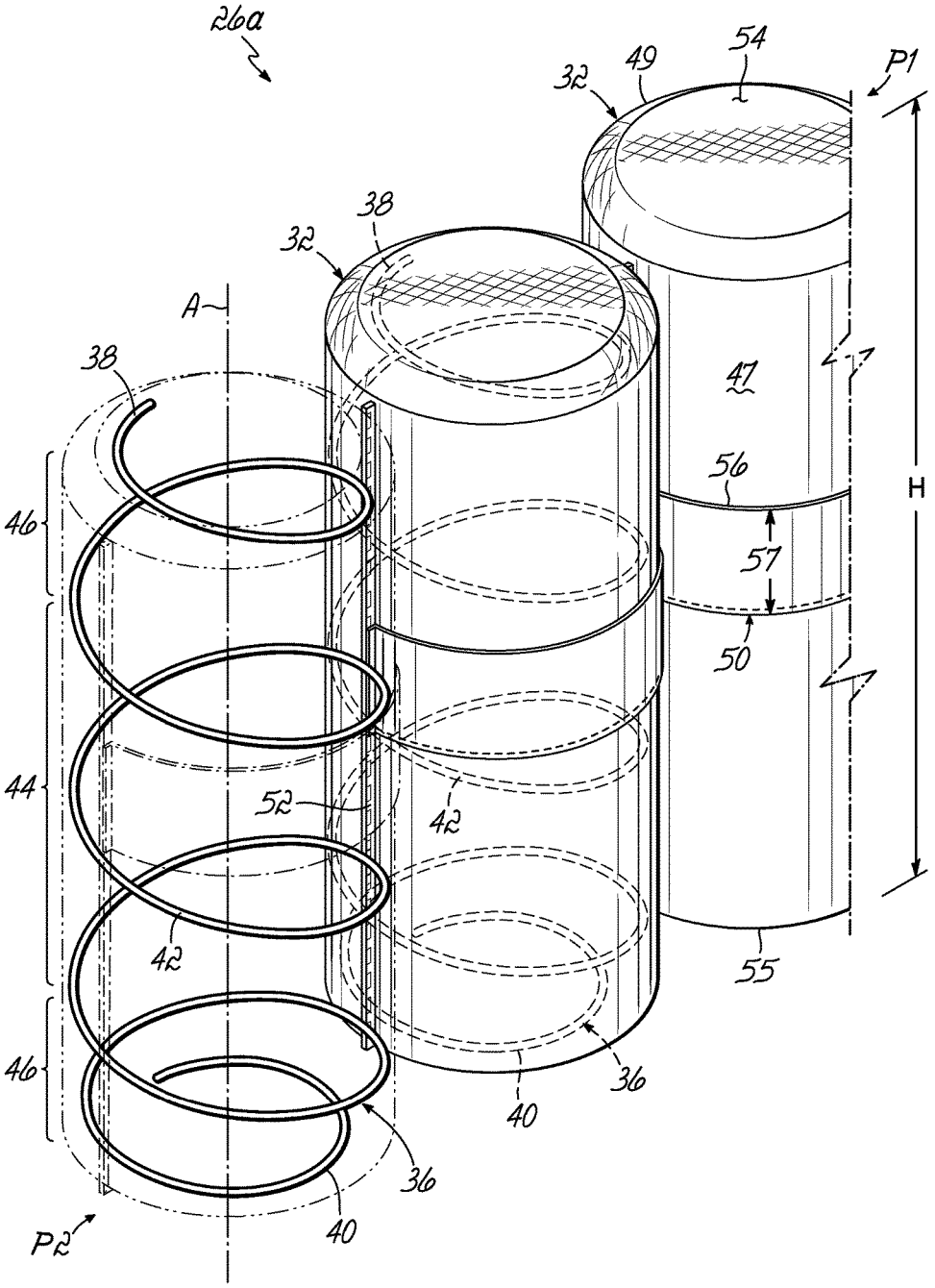
FIG. 3 is a perspective view of a portion of one of the exterior strings of FIG. 2.
Figure 3A:
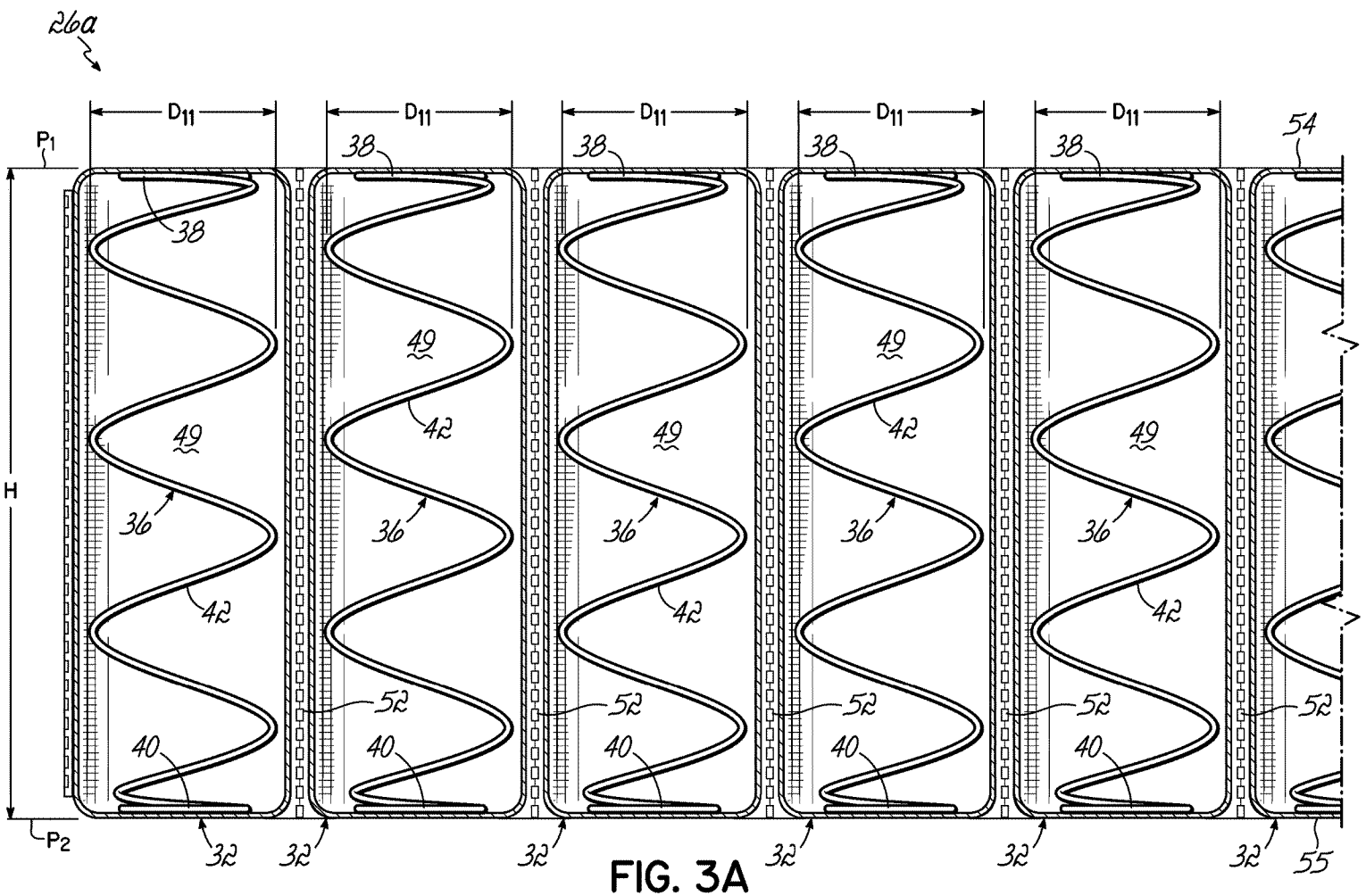
FIG. 3A is a cross-sectional view taken along the line 3A-3A of FIG. 2 showing an outer portion of one of the exterior strings.

FIGS. 2, 3, 3A and 3B show one embodiment of pocketed spring assembly 12 which comprises two different longitudinally extending strings of pocketed springs: exterior strings of springs 26*a* and interior strings of springs 26*b*. As shown in FIGS. 3 and 3A, each of the strings 26*a*, 26*b* of pocketed spring assembly 12 is approximately the same height "H", providing pocketed spring assembly 12 a generally uniform height "H". As shown in FIG. 2, pocketed spring assembly 12 comprises two exterior longitudinally extending strings 26*a* on each side of multiple interior strings 26*b*. The number of exterior and interior strings 26*a*, 26*b* depends on the size of the product 10. Each exterior string 26*a* and each interior string 26*b*, respectively, extends the entire length "L" of the pocketed spring assembly.

As shown in FIG. 2, each set of two exterior strings 26*a* comprises a side section 66 of pocketed spring assembly 12. In some applications, each side section of a pocketed spring assembly may comprise more than or less than two strings of springs per side section. In other words, the number of exterior strings 26*a* may vary depending on the size of the product or other factors, such as the desired amount of side edge support.

As shown in FIGS. 2, 3 and 3A, each exterior string 26*a* comprises a row of interconnected fabric pockets 32. Each of the fabric pockets 32 contains at least one tall coil spring 36. Each tall coil spring 36 is shown in FIG. 8 in an out-of-pocket condition having an out-of-pocket height "$H_2$" and is shown in FIGS. 3 and 3A in an in-pocket condition compressed to a height "H" within one of the pockets 32 of an exterior string 26*a*.

Figure 8:
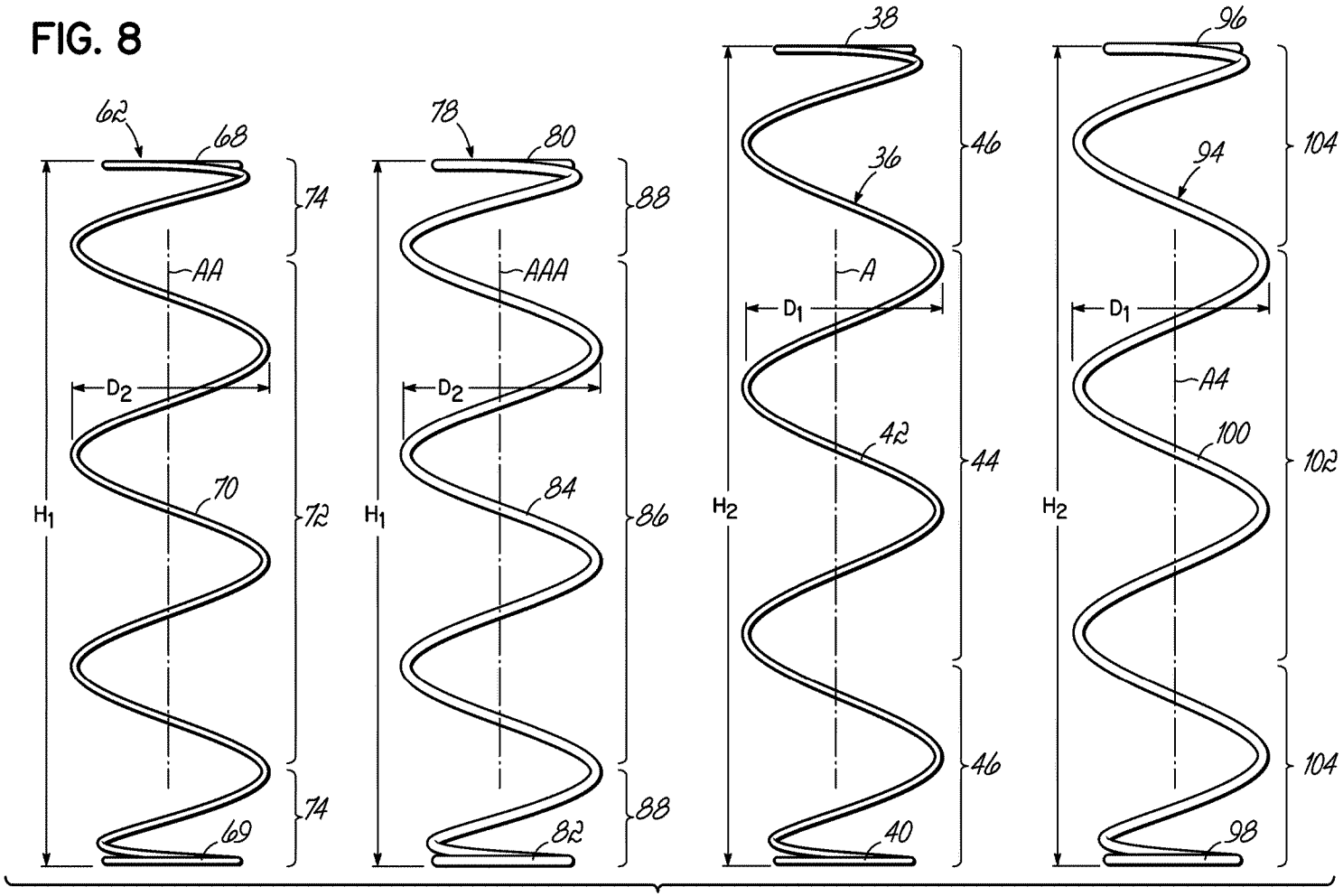
FIG. 8 is a side elevational view, moving left to right, of a core spring, a heavy spring, a tall spring and a heavy tall spring.

As best shown in FIGS. 3 and 8, each tall spring 36 has a central or longitudinal axis A, an upper end turn 38, a lower end turn 40, and a plurality of central convolutions 42 between the end turns. FIGS. 3 and 3A illustrate a barrel-shaped tall spring 36 in which the diameter of the end turns 38, 40 is less than the diameter of the central convolutions 42. As shown in FIG. 8, at least one of the central convolutions 42 has an out-of-pocket barrel diameter $D_1$ greater than the out-of-pocket diameters of the other convolutions of the tall spring 36. As best shown in FIG. 3, each barrel-shaped tall spring 36 is symmetrical, having a center or middle portion 44 and two identical end portions 46.

Figure 3B:
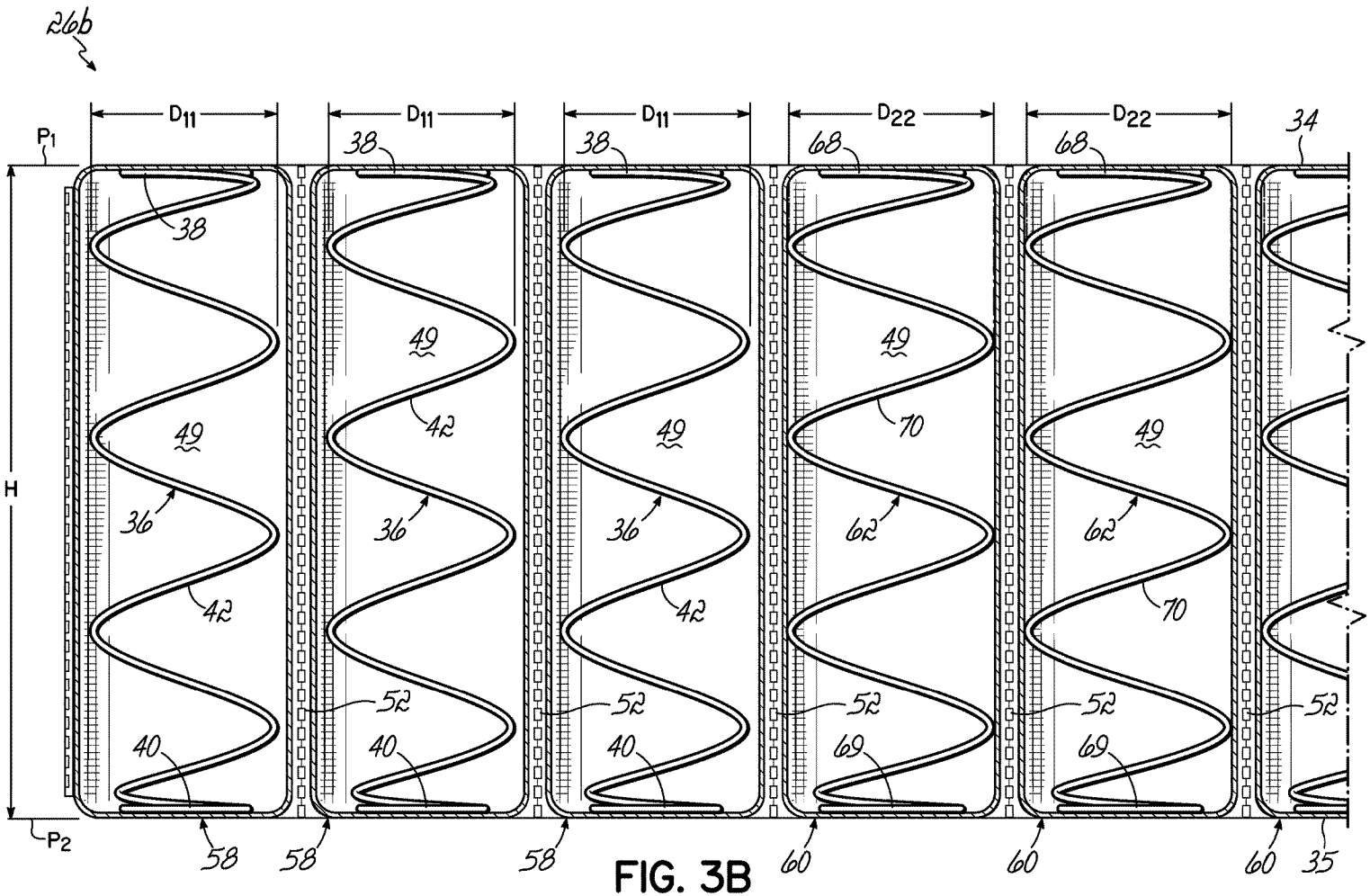
FIG. 3B is a cross-sectional view taken along the line 3B-3B of FIG. 2 showing an outer portion of one of the interior strings.

Upon being compressed and inserted into one of the pockets 32 of one of the external strings 26*a* as shown in FIG. 3A or one of the outer pockets 58 of one of the interior string 26*b* as shown in FIG. 3B, the barrel diameter $D_1$ of tall spring 36 shown in FIG. 8 expands or increases to pocketed barrel diameter $D_{11}$, as shown in FIGS. 3A and 3B.

Preferably, one piece of fabric is used to create each exterior string 26*a*, the piece of fabric being folded over onto itself around the tall coil springs 36. As best shown in FIG. 3, opposite sides or plies 47, 49 of the fabric are welded or otherwise secured together to create a longitudinal seam 50 and a plurality of separating or transverse seams 52 of any desired length. FIG. 3 illustrates ply 47 being closest to the reader and ply 49 being behind the springs 36 or away from the reader. Although the drawings show separating or transverse seams 52 being a certain length, they may be any intended length and are not intended to be limited to the drawings. For example, they may be less than the height of the string in which they are used, as is known in the industry as "split top".

Although the seams or welds in the embodiments shown herein are shown as being heat-welded spaced rectangles, any of the seams described herein may be spaced dots, triangles or solid line segments without spaces.

As best shown in FIG. 3, opposed edges 56 of the piece of fabric used to create the exterior strings 26*a* are aligned and spaced from the longitudinal seam 50 a linear distance indicated by numeral 57. Although the drawings indicated the longitudinal seam 50 being below the free edges 56 of the piece of fabric, the longitudinal seam 50 may be above the free edges 56 of the piece of fabric.

As shown in FIGS. 3 and 3A, exterior string 26*a* has a generally planar top surface 54 in a top plane $P_1$ and a parallel generally planar bottom surface 55 in a bottom plane $P_2$. The linear distance between the top and bottom surfaces 54, 55 of the exterior string 26*a* defines a height H of the string 26*a*. This linear distance further defines the height H of the pocketed spring assembly 12 because each of the exterior strings 26*a* and interior strings 26*b* has approximately the same height. FIG. 3B shows an interior string 26*b* having the same height H defined as the linear distance between top and bottom surfaces 34, 35 of the interior string 26*b*.

Figure 9:
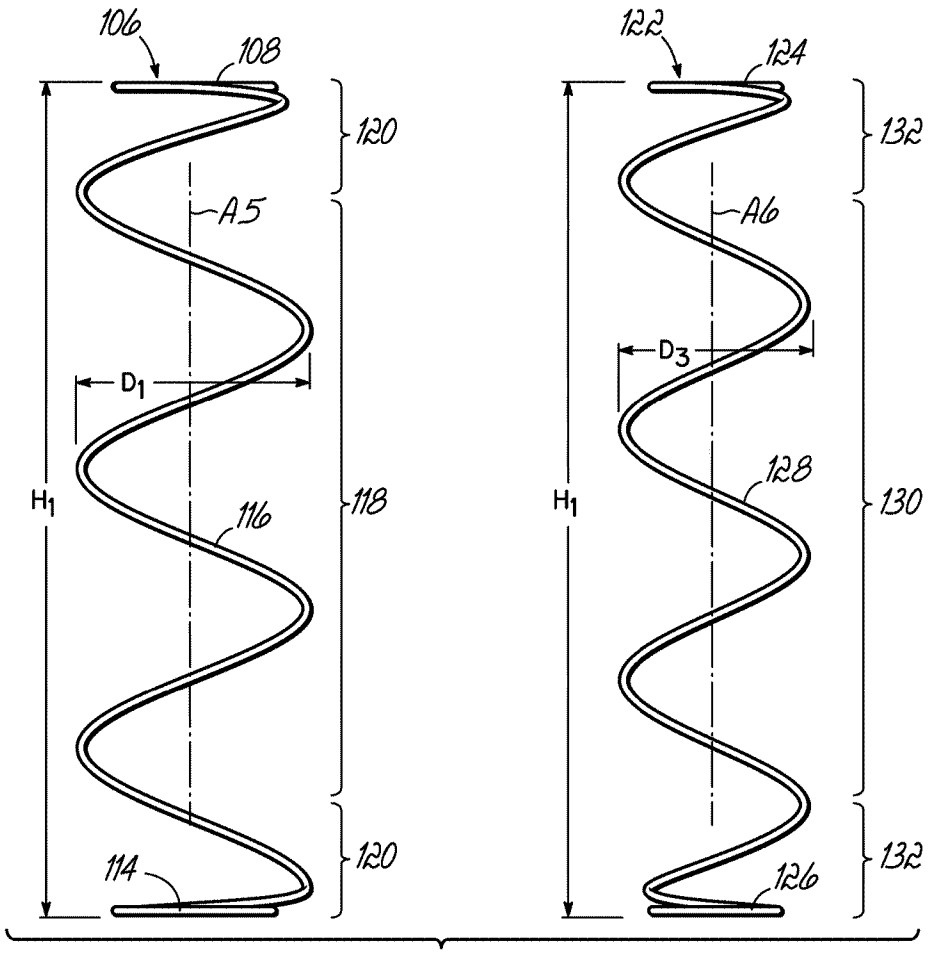
FIG. 9 is a side elevational view, moving left to right, of a stiff spring and a narrow spring.
Figure 10A:
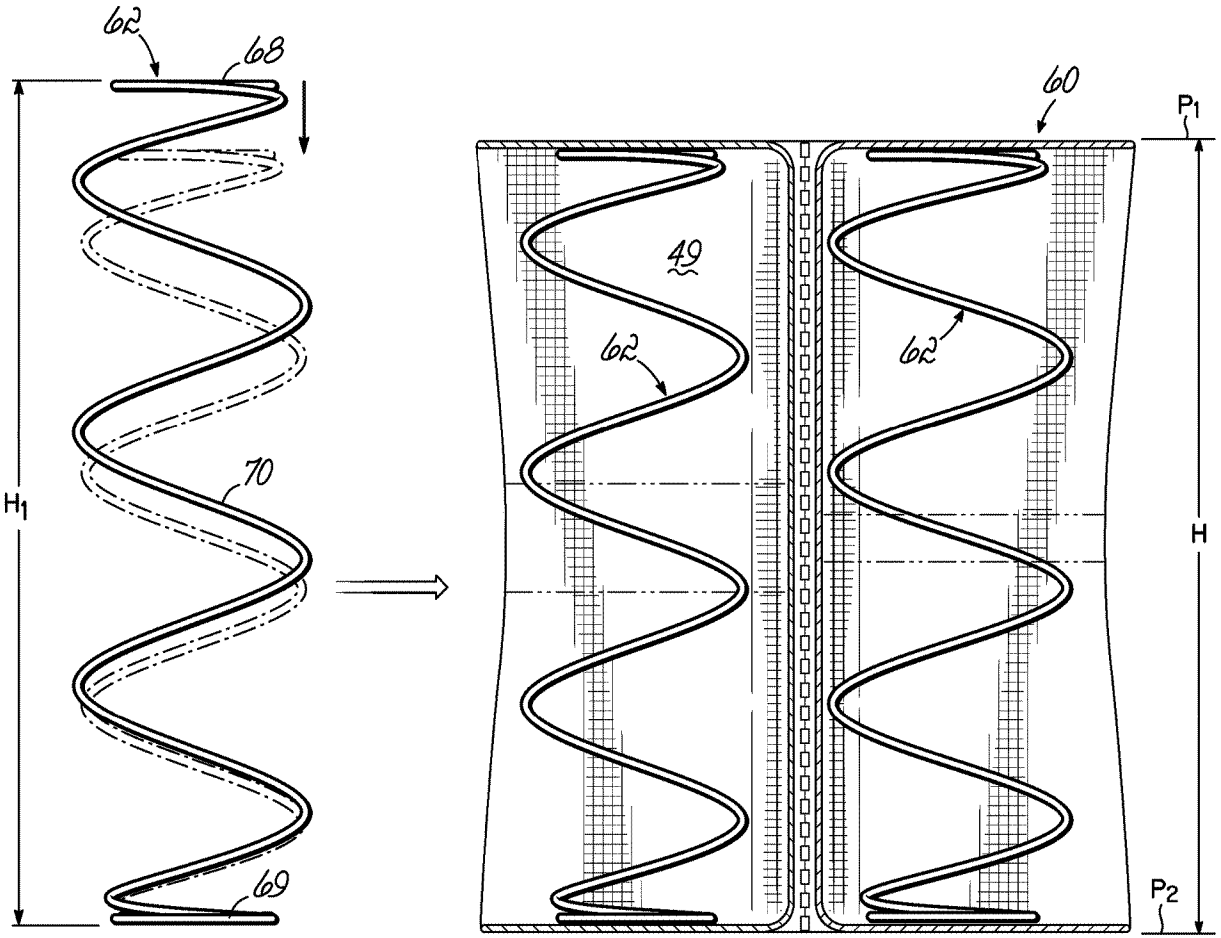
FIG. 10A is a side elevational view of a core spring being compressed and pocketed.
Figure 10B:
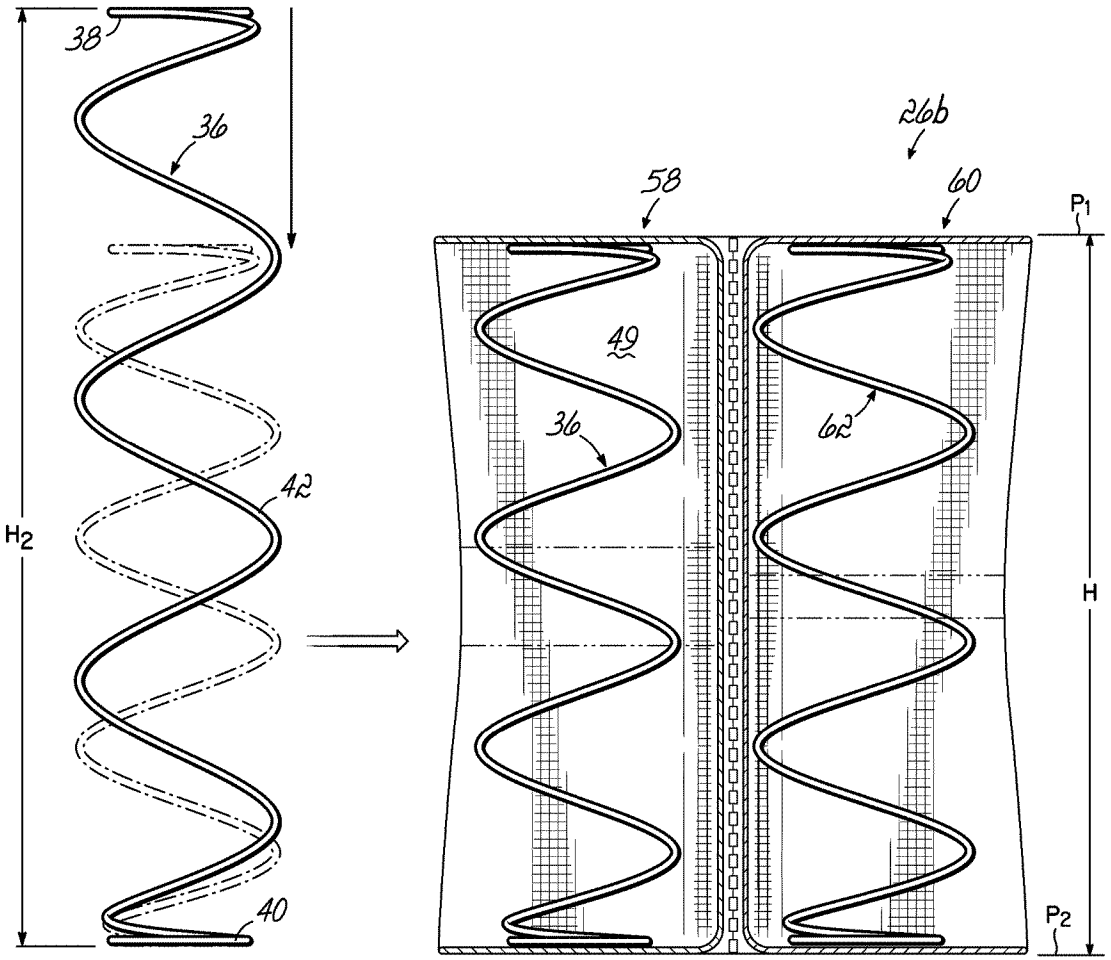
FIG. 10B is a side elevational view of a heavy spring being compressed and pocketed.

FIGS. 8 and 9 show coil springs having different properties which may be inserted into pockets of different sizes within a string to vary the firmness within a fully assembled string, but keep the string a generally uniform height. As shown in FIG. 8, each of the tall springs 36 has an out-of-pocket height "$H_2$" greater than the out-of-pocket height $H_1$ of the core and heavy springs, 62, 78, respectively. As shown in FIG. 10B, when compressed and inserted into a pocket 32 of an exterior string 26*a* or into an outer pocket 58 of an interior string 26*b*, the height of the tall spring 36 shortens from "$H_2$" to "H".

Referring to FIG. 2, each interior string 26*b* of pocketed spring assembly 12 comprises a row of interconnected fabric pockets 58, 60 of the same height. Three fabric pockets 58 are located at each end of each interior string 26*b* with fabric pockets 60 therebetween. For purposes of this document, the outermost pockets 58 are considered outer pockets of the interior string 26*b*, and the pockets 60 therebetween are considered inner pockets of the interior string 26*b*. Within each interior string 26*b*, each outer pocket 58 contains at least one tall spring 36, and each inner pocket 60 contains at least one core spring 62. Although the drawings show each interior string 26*b* of pocketed spring assembly 12 having three outer pockets 58 at each end, it is within the scope of the invention that each interior string 26*b* may have one, two or any number of outer pockets 60 at each end of the interior string 26*b*.

As shown in FIG. 2, pocketed spring assembly 12 has opposite end sections 64 made up of solely pocketed tall springs 36. The end sections 64 and side sections 66, each containing pocketed tall springs 36, make up a picture-frame shape of edge support which provides increased stiffness around the perimeter of the pocketed spring assembly 12 without any step because of the different sizes of pockets before the pockets are loaded with springs.

In this embodiment, the pocketed spring assembly 12 has a four-sided perimeter section 110 surrounding an interior or core section 112. The perimeter section 110 of pocketed spring assembly 12 comprises pocketed tall springs 36. The core section 112 comprises pocketed core springs 62. The pocketed spring assembly 12 has a uniform height H. Each side of the perimeter section 110 is firmer than the core section 112 due to the out-of-pocket properties of the two different springs (tall and core springs) in the two different sections: perimeter section 110 and core section 112. See FIG. 2.

As shown in FIG. 3B, each of the core springs 62 contained in inner pockets 60 of the interior string 26*b* is shown in an out-of-pocket or relaxed condition in FIG. 8. Each core spring 62 is generally barrel-shaped, like tall springs 36 described above, but shorter than tall springs 36 out-of-pocket. As best shown in FIG. 8, each core spring 62 has a central or longitudinal axis AA, an upper end turn 68, a lower end turn 69 and a plurality of central convolutions 70 between the end turns. FIG. 8 illustrates a barrel-shaped core coil spring 62 in which the diameter of the end turns 68, 69 is less than the diameter of the central convolutions 70. As best shown in FIG. 8, at least one of the central convolutions 70 has an out-of-pocket barrel diameter $D_2$ greater than the diameters of the other convolutions of the core spring 62. As best shown in FIG. 8, each barrel-shaped core spring 62 is symmetrical, having a center or middle portion 72 and two identical end portions 74. Although symmetrical barrel-shaped springs are shown in the drawings, the present invention may be used with any shapes of springs.

Upon being compressed and inserted into one of the inner pockets 60 of one of the interior strings 26*b*, the barrel diameter $D_2$ of core spring 62 shown in FIG. 8 expands to a barrel diameter $D_{22}$, as shown in FIG. 3B. As shown in FIG. 10A, when compressed and inserted into an inner pocket 60 of an interior string 26*b*, the height of the core coil spring 62 shortens to "H".

In some embodiments, each of the tall springs 36 within each of the exterior strings 26*a* of pocketed spring assembly 12 is made of the same gauge wire. In some embodiments, each of the core and tall springs 62, 36, respectively, within each of the interior strings 26*b* of pocketed spring assembly 12, is made of the same gauge wire. Thus, all the pocketed springs of the pocketed spring assembly 12 may be made of the same gauge wire. In one embodiment, all the springs may be made of 14-gauge wire; in another embodiment, each of the springs may be made of 13.75-gauge wire.

As shown in FIG. 8, in a relaxed or out-of-pocket condition, each of the core springs 62 has a lesser out-of-pocket height $H_1$, i.e., is shorter than the out-of-pocket height $H_2$ of the tall springs 36. Additionally, as shown in FIG. 8, in a relaxed condition, each of the core springs 62 has a greater out-of-pocket barrel diameter $D_2$ or is wider than the out-of-pocket barrel diameter $D_1$ of the tall springs 36.

In one embodiment in which the height of the pocketed spring assembly is eight inches, the out-of-pocket height "$H_2$" of each of the tall springs 36 is approximately 270 millimeters, and the out-of-pocket height "$H_1$" of each of the core springs 62 is approximately 230 millimeters. The tall springs 36 and core springs 62 have approximately the same in-pocket or compressed height "H" of eight inches or 203 millimeters. In this embodiment, each of the core springs 62 has an 80 millimeter barrel diameter in a relaxed or out-of-pocket condition compared to the 77 millimeter barrel diameter of the tall spring 36 in a relaxed or out-of-pocket condition. See FIG. 8.

Figure 3C:
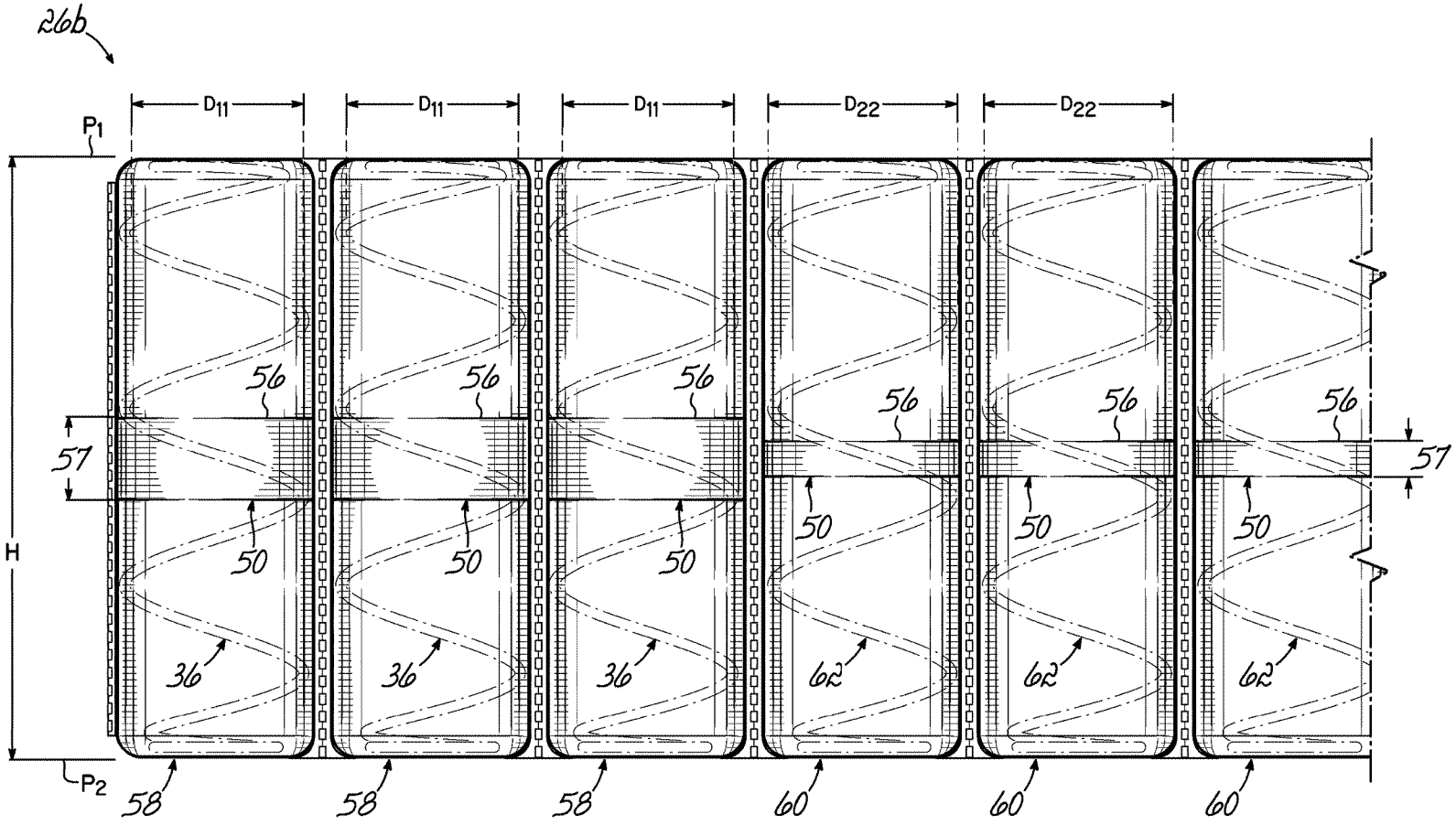
FIG. 3C is a side elevational view showing an outer portion of one of the interior strings.

As shown in FIG. 3C, the location of the longitudinal seams 50 of the outer pockets 58 of each of the interior strings 26*b* is below the location of the longitudinal seams 50 of the inner pockets 60. Thus, the size or height of the outer pockets 58 is less than the size or height of the inner pockets 60 due to the different locations of the longitudinal seams 50 before the tall and core springs 36, 62 are inserted into the outer and inner pockets 58, 60, respectively, and the pockets closed. The different locations of the longitudinal seams within a string create pockets of different sizes before springs are closed in the pockets within the string. The concept of creating different preloaded pocket sizes due to changing the location of the longitudinal seams of the pockets within a string is the crux of the present invention regardless of which different springs are pocketed within a string. As described above, the different sizes of pre-loaded pockets allow the fabric pockets to stretch when subject to different forces of the different springs inside the pockets so that a string may have a uniform height yet different pocketed springs along its length without any step along the string.

Figure 4A:
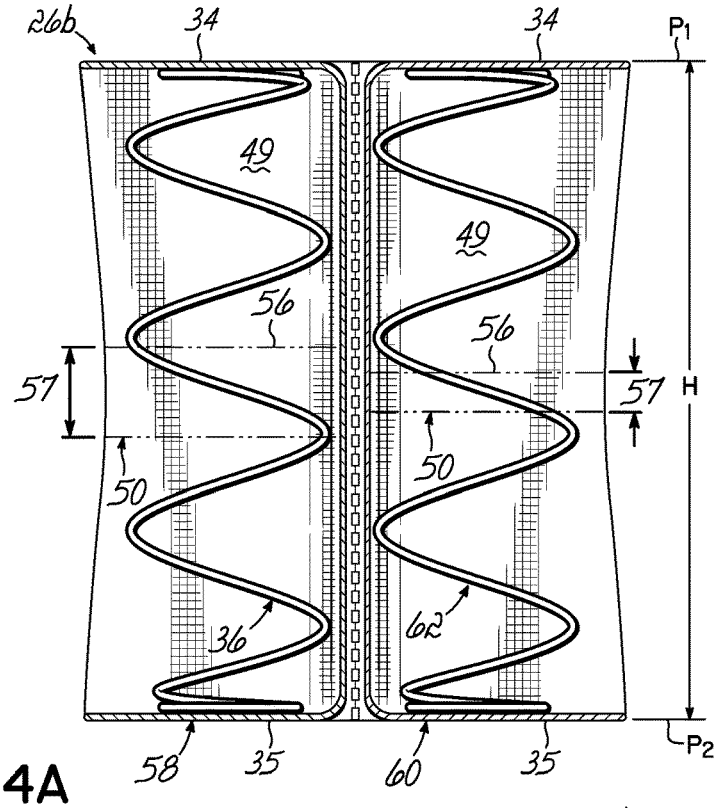
FIG. 4A is a cross-sectional view of a portion of an interior string of the pocketed spring assembly of FIG. 1 showing two pocketed springs of the same height containing different coil springs.
Figure 4B:
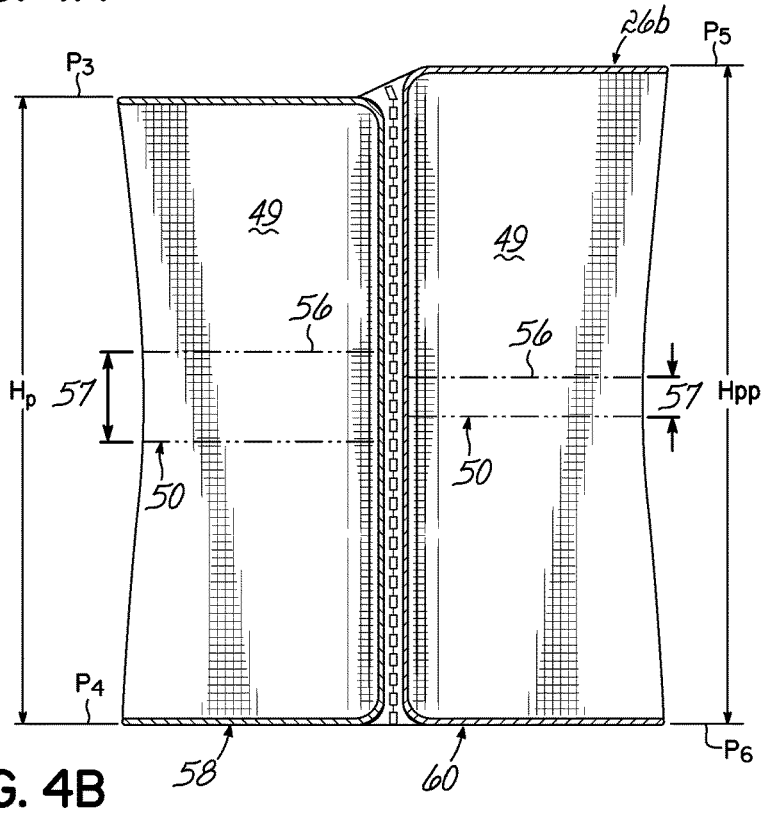
FIG. 4B is a cross-sectional view of the portion of the interior string of FIG. 3A showing two pockets of different sizes due to the location of the longitudinal seams of the pockets before the springs of FIG. 3A are inserted in the pockets.

This concept is shown in FIGS. 4A and 4B. FIG. 4B shows one of the longitudinal seams 50 of one of the outer pockets 58 below the longitudinal seam 50 of adjacent inner pocket 60 of an interior string 26*b*. Thus, the preloaded outer pockets 58 are smaller in size than the preloaded inner pockets 60 of interior strings 26*b*. More particularly, the height $H_p$ of the preloaded outer pockets 58 is smaller in size than the height $H_{pp}$ of the preloaded inner pockets 60 of interior strings 26*b*. The height $H_p$ of the preloaded smaller outer pockets 58 is defined as the linear distance between top and bottom planes $P_3$ and $P_4$, respectively. The height $H_{pp}$ of the preloaded larger inner pockets 60 is defined as the linear distance between top and bottom planes $P_5$ and $P_6$, respectively. As shown in FIGS. 4A and 4B, the linear distance 57 between the upper edges 56 of the piece of fabric used to make interior string 26*b* and the longitudinal seam 50 is greater in the outer pockets 58 than the inner pockets 60.

As shown in FIG. 4A, when the tall and core springs 36, 62, for example, are inserted into the outer and inner pockets 58, 60, respectively, the loaded outer and inner pockets 58, 60 of interior strings 26*b* expand to a height H, larger than either of the heights $H_p$, $H_{pp}$ of the preloaded outer and inner pockets 58, 60, respectively. The height H is the linear distance between the top and bottom surfaces 34, 35 of the interior strings 26*b*.

Figure 5:
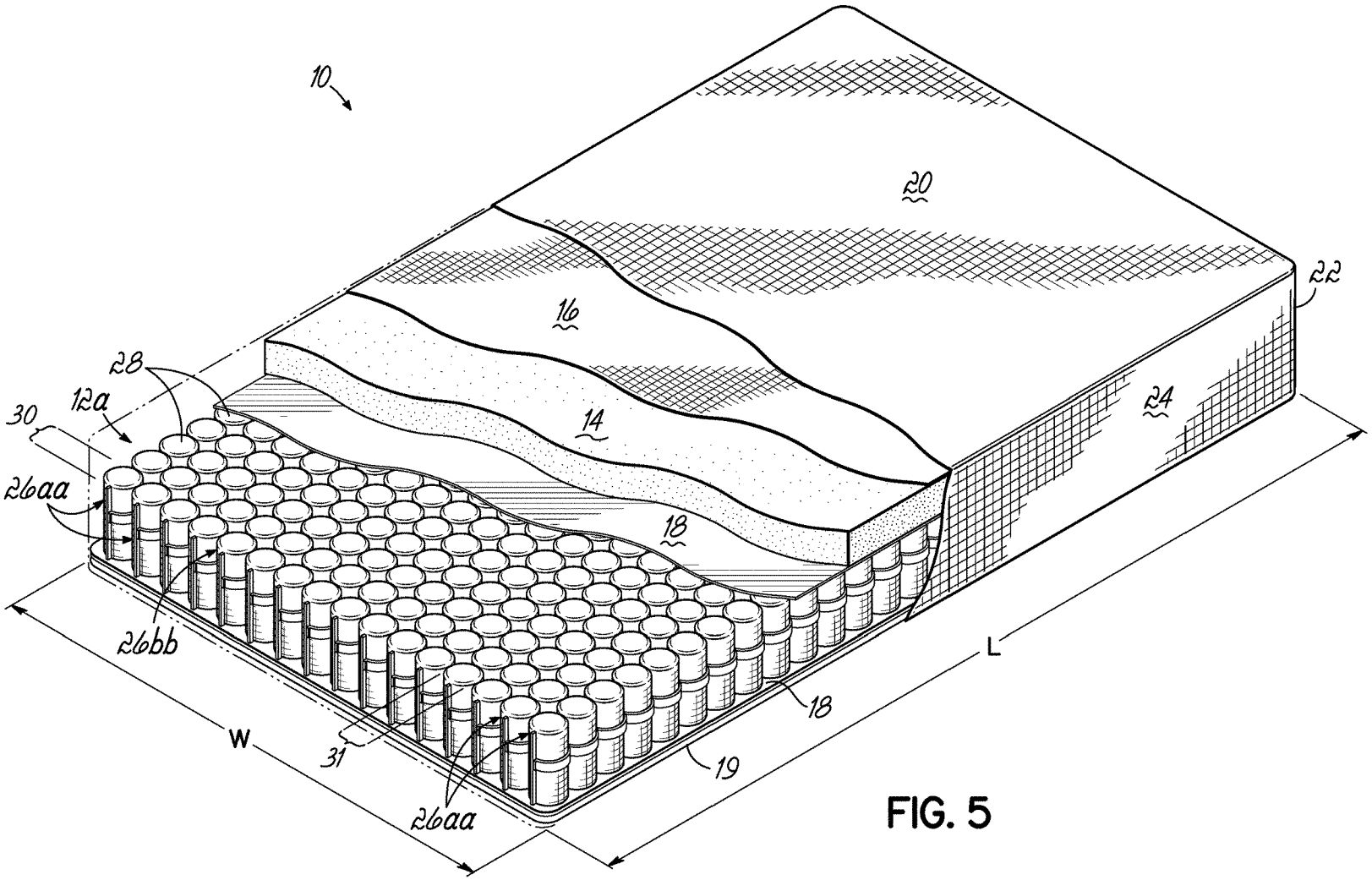
FIG. 5 is a perspective view, partially broken away, of a bedding or seating product incorporating another embodiment of pocketed spring assembly.

FIGS. 5-7B illustrate a portion of another embodiment of pocketed spring assembly 12*a* which may be incorporated into any of the products shown or described herein. This embodiment of pocketed spring assembly 12*a* comprises two different longitudinally extending strings of springs: exterior strings of springs 26*aa* and interior strings of springs 26*bb*. As shown in FIGS. 5, 6A, 6B, 6C and 7A, each of the strings 26*aa*, 26*bb* of pocketed spring assembly 12*a* is approximately the same height "H". As shown in FIG. 5, pocketed spring assembly 12*a* comprises two exterior strings of springs 26*aa* on each side of multiple interior strings of springs 26*bb*. Each exterior string of springs 26*aa* and each interior string of springs 26*bb*, respectively, extends the entire length "L" of pocketed spring assembly 12*a* of the mattress or product in which it is used. Each set of two exterior strings of springs 26*aa* comprises a side section 66*a* of pocketed spring assembly 12*a*. In some applications, each side section 66*a* of the pocketed spring assembly 12*a* may comprise more than or less than two strings of springs per side section. In other words, the number of exterior strings 26*aa* may vary depending on the size of the product or other factors, such as the desired amount of side edge support.

Figure 5A:
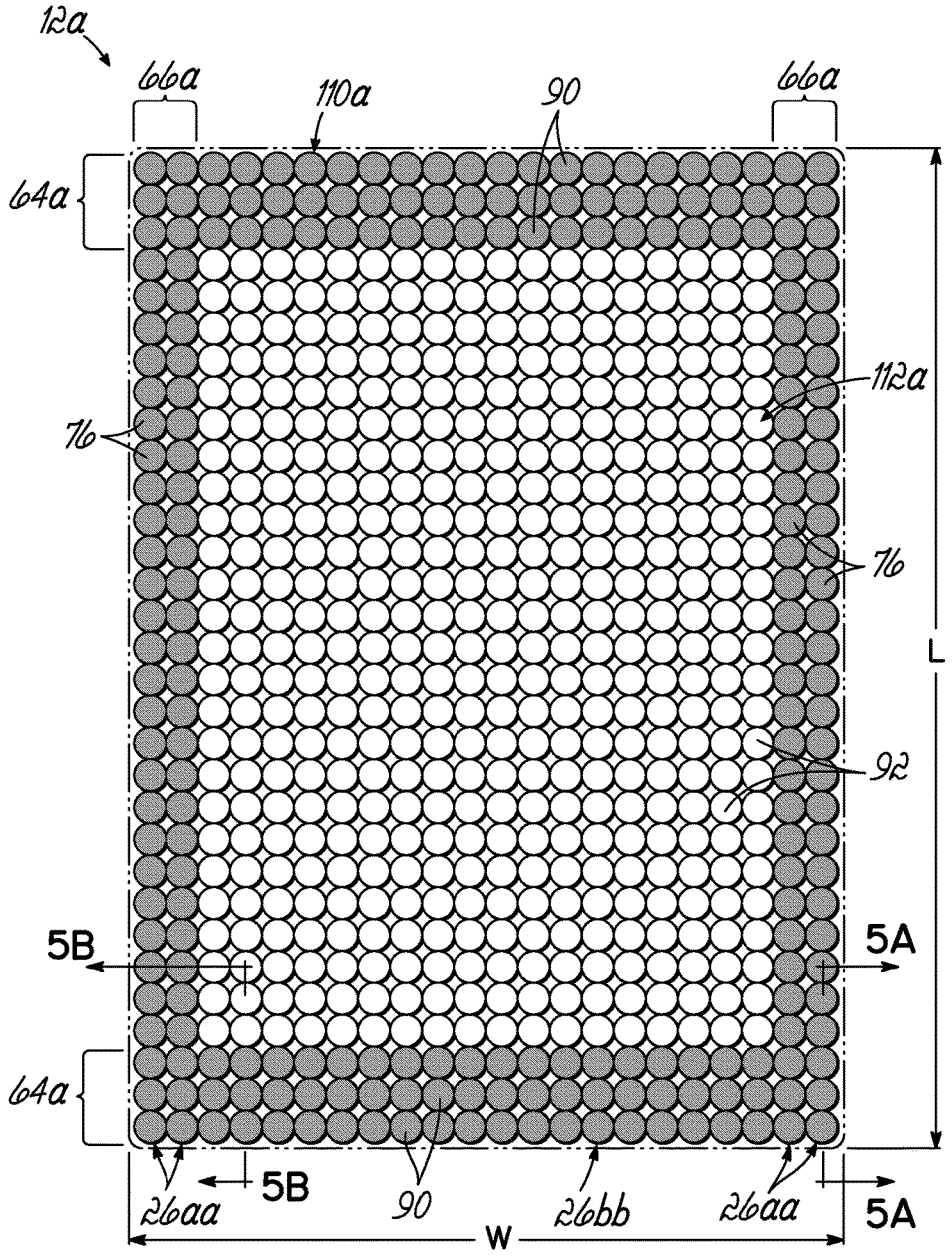
FIG. 5A is a top view of the pocketed spring assembly of FIG. 5.
Figure 6A:
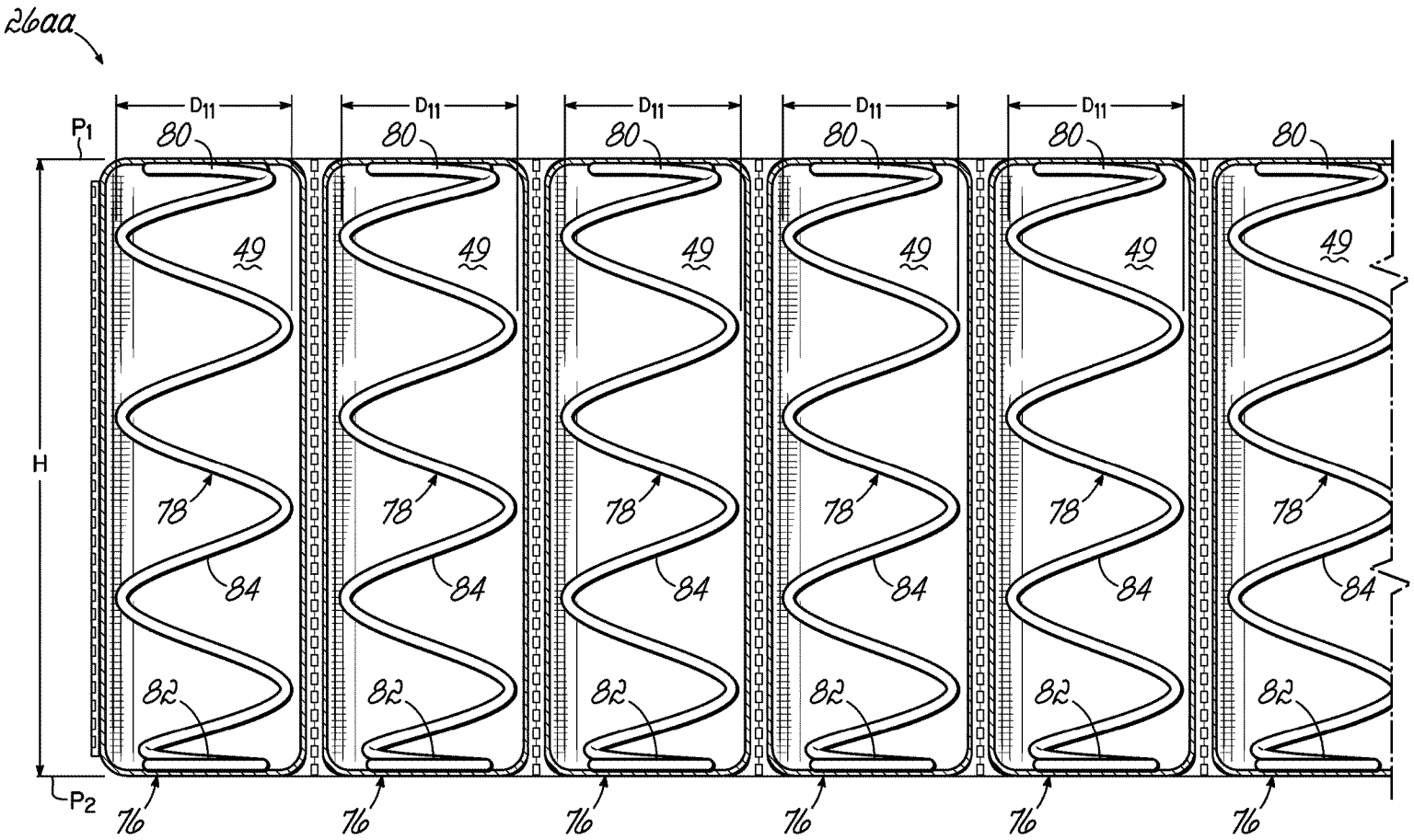
FIG. 6A is a cross-sectional view showing an outer portion of one of the exterior strings of the pocketed spring assembly of FIG. 5.

As shown in FIGS. 5A and 6A, each exterior string 26*aa* comprises a row of interconnected fabric pockets 76. Each of the fabric pockets 76 of exterior string 26*aa* contains at least one "heavy" coil spring 78 compressed to a height "H" within the pocket 76 of exterior string 26*aa*. FIG. 8 shows one of the heavy springs 78 in an out-of-pocket or relaxed condition. The heavy spring 78 has a central or longitudinal axis AAA, an upper end turn 80, a lower end turn 82 and a plurality of central convolutions 84 between the end turns 80, 82. The heavy spring 78 is barrel-shaped, the diameter of the end turns 80, 82 being smaller than the diameter of the central convolutions 84. At least one of the central convolutions 84 has a barrel diameter $D_2$ greater than the diameters of the other convolutions of the spring. As shown in FIG. 8, the out-of-pocket barrel diameter $D_2$ of the heavy spring 78 is approximately identical to the out-of-pocket barrel diameter $D_2$ of the core spring 62. In one preferred embodiment, this out-of-pocket barrel diameter $D_2$ is approximately 78 millimeters.

Figure 10C:
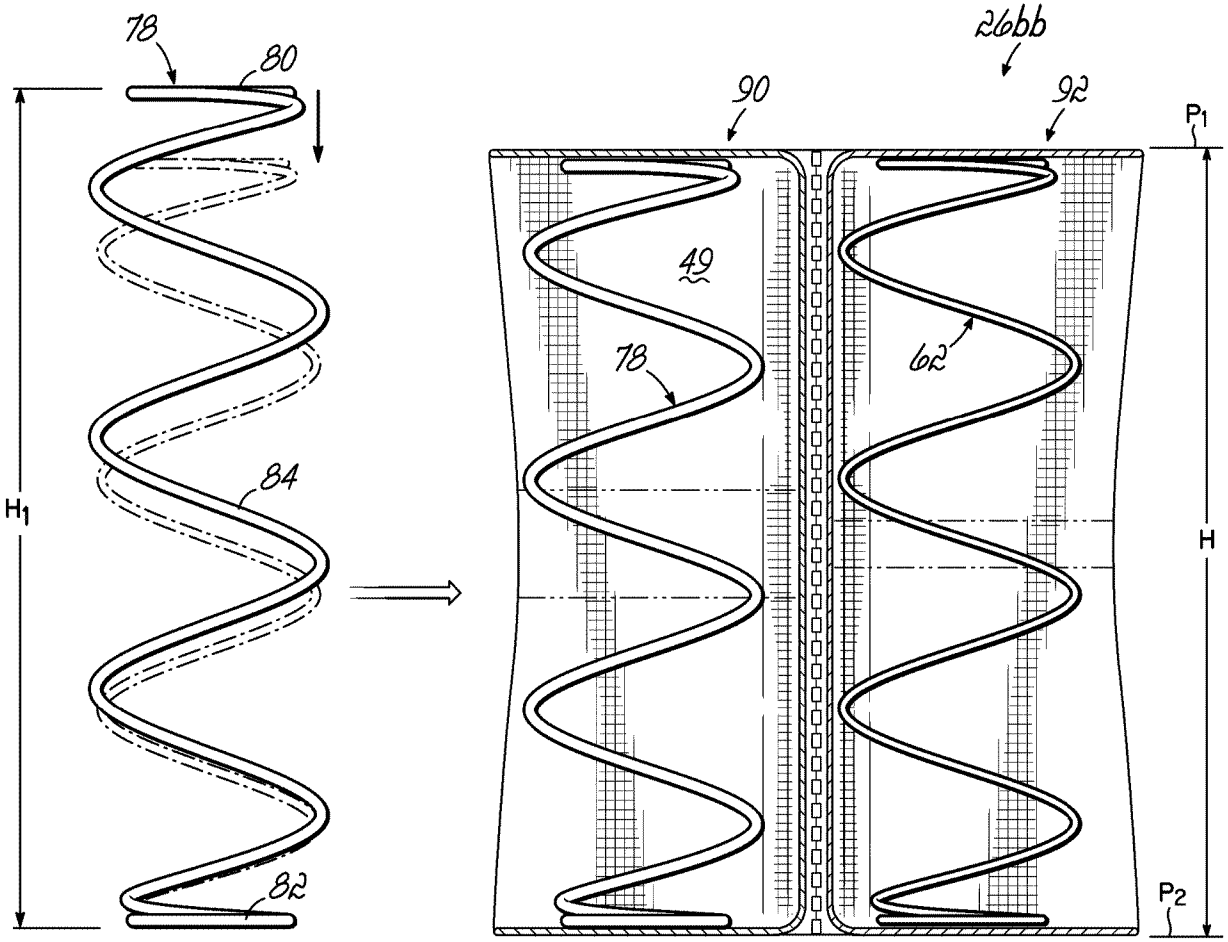
FIG. 10C is a side elevational view of a tall spring being compressed and pocketed.

As best shown in FIGS. 8 and 10C, each barrel-shaped heavy spring 78 is symmetrical, including a center or middle portion 86 and two identical end portions 88. Upon being compressed and inserted into one of the pockets 76 of exterior string 26*aa*, the barrel diameter $D_2$ of heavy spring 78 shown in FIG. 8 expands to barrel diameter $D_{11}$ shown in FIGS. 6A, 6B and 6C.

As shown in FIGS. 5, 5A and 6A, each pocket 76 of each exterior string 26*aa* has a heavy spring 78 therein in a compressed condition. As shown in FIGS. 8 and 10C, each of the heavy springs 78 has an out-of-pocket height "$H_1$" approximately the same as the out-of-pocket height of the core springs 62. In one preferred embodiment, this out-of-pocket height "$H_1$" is approximately 230 millimeters. When compressed and inserted into a pocket 76 of an exterior string 26*aa*, the height of the heavy spring 78 shortens to "H", which in one preferred embodiment, is approximately eight inches or 200 millimeters. As best seen in FIG. 8, in a relaxed or out-of-pocket condition, the heavy spring 78 has the same barrel diameter and out-of-pocket height and number of turns as the core spring 62. However, the heavy spring 78 is made of a thicker or heavier gauge wire than core spring 62. In one embodiment, the heavy springs 78 are made of 13.75-gauge wire, and the core springs 62 are made of 14-gauge wire. These gauges are not intended to be limiting, but merely an example.

Figure 6B:
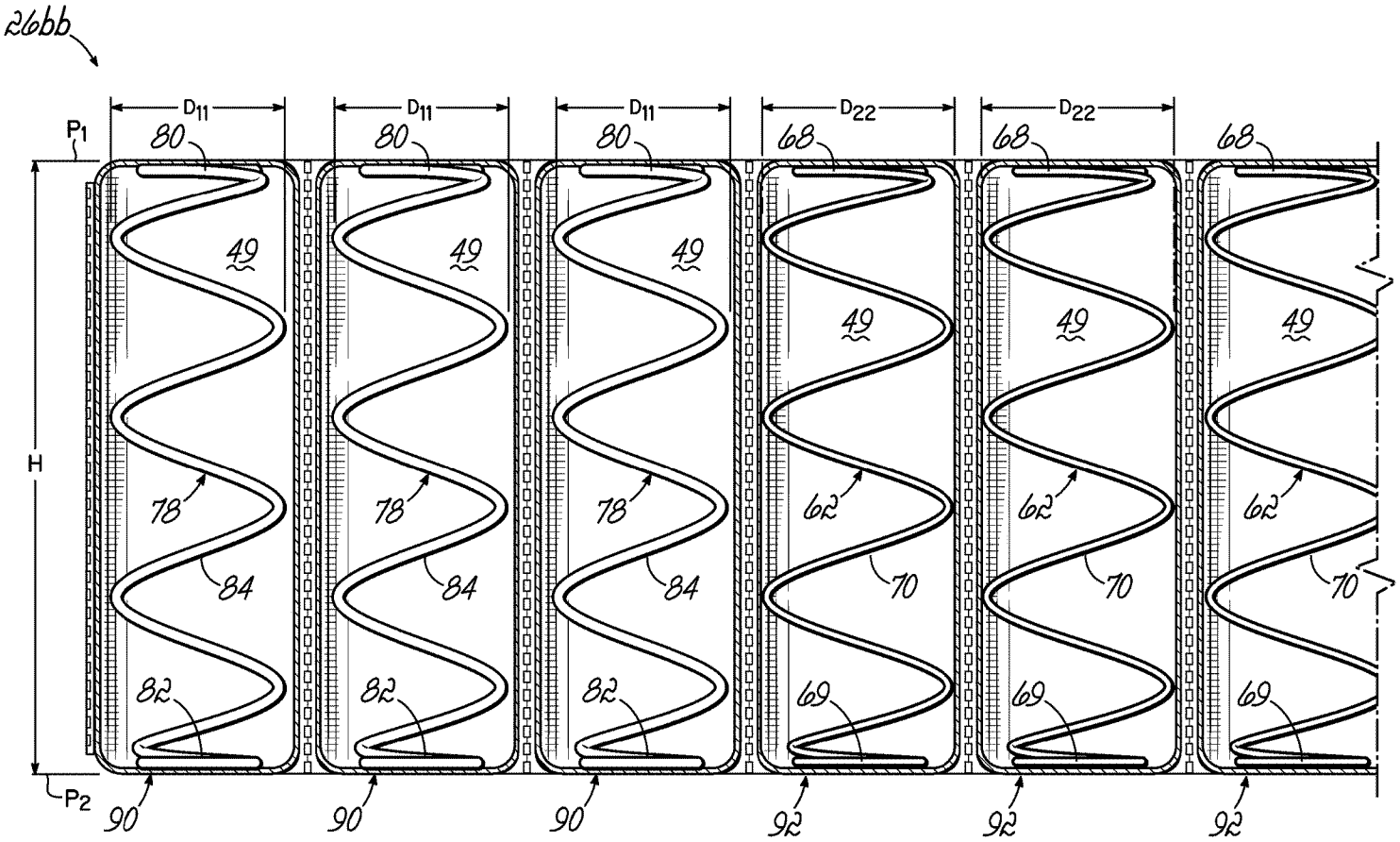
FIG. 6B is a cross-sectional view showing an outer portion of one of the interior strings of the pocketed spring assembly of FIG. 5.

As shown in FIGS. 5, 5A and 6B, each interior string 26*bb* of pocketed spring assembly 12*a* comprises a row of interconnected fabric pockets 90, 92. Each interior string 26*bb*, as well as each exterior string 26*aa* of pocketed spring assembly 12*a* has a height "H". Three of the pockets 90 at each end of each interior string 26*bb* contain at least one heavy spring 78. These six outer pockets 90 (three on each end) are considered outer pockets 90 of the interior string 26*bb* for purposes of this document. For purposes of this document, the pockets between the outer pockets 90 are considered inner pockets 92 of each interior string 26*bb*. Within each interior string 26*bb*, each outer pocket 90 contains at least one heavy spring 78, and each inner pocket 92 contains at least one core spring 62.

Although the pocketed spring assembly 12*a* shows each interior string 26*d* having three outer pockets 90 at each end, each outer pocket 90 containing at least one heavy spring 78, each interior string 26*bb* may have more than or less than three outer pockets 90 at each end, each outer pocket 90 containing at least one heavy spring 78.

As shown in FIG. 5A, pocketed spring assembly 12*a* has opposite end sections 64*a* made up of heavy springs 78 in outer pockets 90 of interior strings 26*bb* and heavy springs 78 in some pockets 76 of exterior strings 26*aa*. Pocketed spring assembly 12*a* also has opposite side sections 66*a* made up of heavy springs 78 in outer pockets 76 of exterior strings 26*aa*. The end sections 64*a* and side sections 66*a* made up a picture-frame shape of edge support which provides increased stiffness around the perimeter of the pocketed spring assembly 12*a*.

In this embodiment, the pocketed spring assembly 12*a* has a four-sided perimeter section 110*a* surrounding an interior or core section 112*a*. The pocketed springs of the perimeter section 110*a* of pocketed spring assembly 12*a* comprise pocketed heavy springs 78. The pocketed springs of the core section 112*a* are pocketed core springs 62. The pocketed spring assembly 12*a* has a uniform height H. Each side of the perimeter section 110*a* is firmer than the core section 112*a* due to the out-of-pocket characteristics or properties of the different springs (heavy and core springs) in the two different sections: perimeter section 110*a* and core section 112*a*. See FIG. 5A.

Although the pocketed spring assembly 12*a* shows two exterior strings 26*aa* per side section 66*a*, each side section 66*a* may comprise more than or less than two exterior strings 26*aa* per side section 66*a*. Similarly, although the pocketed spring assembly 12*a* shows three rows of pockets per end section 64*a*, each end section 64*a* may comprise more than or less than three rows of pockets per end section 64*a*.

As shown in FIG. 10C, each of the heavy springs 78 has an out-of-pocket height "$H_1$" which, in one preferred embodiment, is approximately 260 millimeters. When compressed and inserted into an exterior pocket 76 of an exterior string 26*aa* or an outer pocket 90 of an interior string 26*bb* of pocketed spring assembly 12*a*, the height of the heavy spring 78 shortens to "H" which, in one preferred embodiment, is approximately eight inches or 200 millimeters, but may be any desired dimension.

Figure 6C:
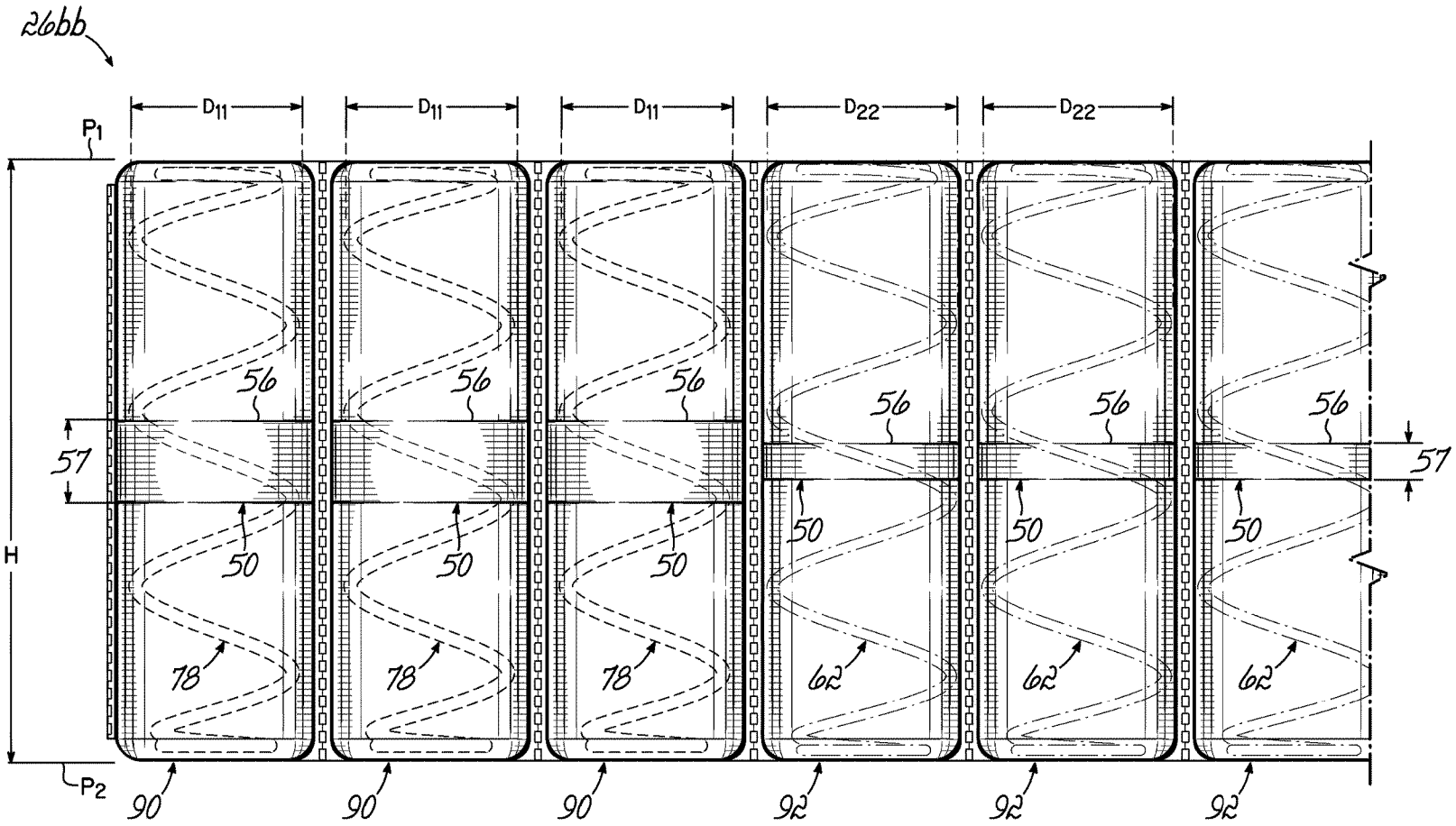
FIG. 6C is a side elevational view showing an outer portion of one of the interior strings of the pocketed spring assembly of FIG. 5.

As shown in FIG. 6C, the location of the longitudinal seams 50 of the outer pockets 90 of each of the interior strings 26*bb* is below the location of the longitudinal seams 50 of the inner pockets 92. Thus, the size or height of the outer pockets 90 is less than the size or height of the inner pockets 92 due to the different locations of the longitudinal seams 50 before the heavy and core springs 78, 62 are inserted into the outer and inner pockets 90, 92, respectively. The different locations of the longitudinal seams to create pockets of different sizes is the crux of the present invention regardless of which springs are used. As described above, the different sizes of pre-loaded pockets mask the tendency of the fabric to stretch when subject to substantial force of the springs inside the pockets so that a string may have a uniform height, yet different pocketed springs along its length without any step.

Figure 7A:
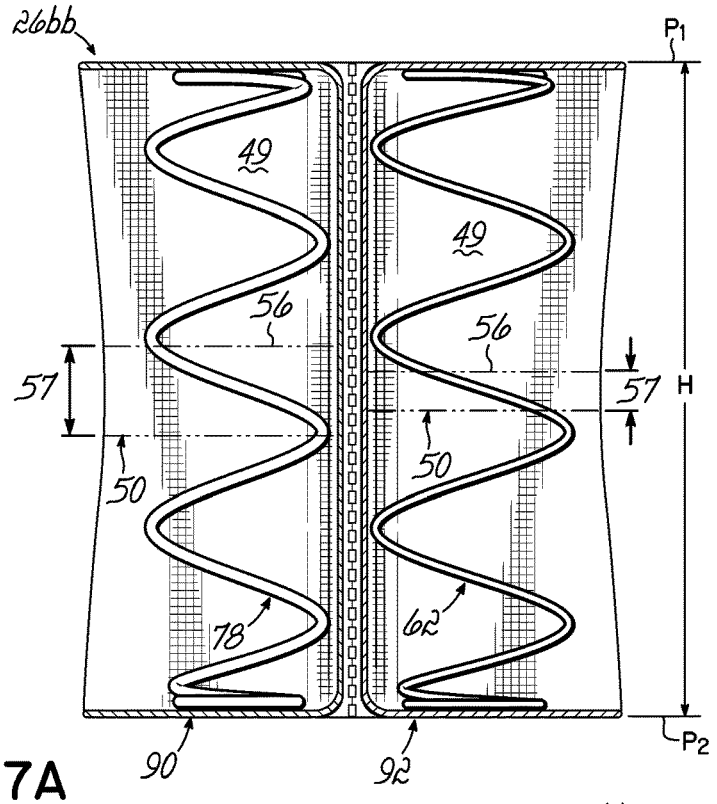
FIG. 7A is a cross-sectional view of a portion of an interior string of the pocketed spring assembly of FIG. 5 showing two pocketed springs of the same height containing different coil springs.
Figure 7B:
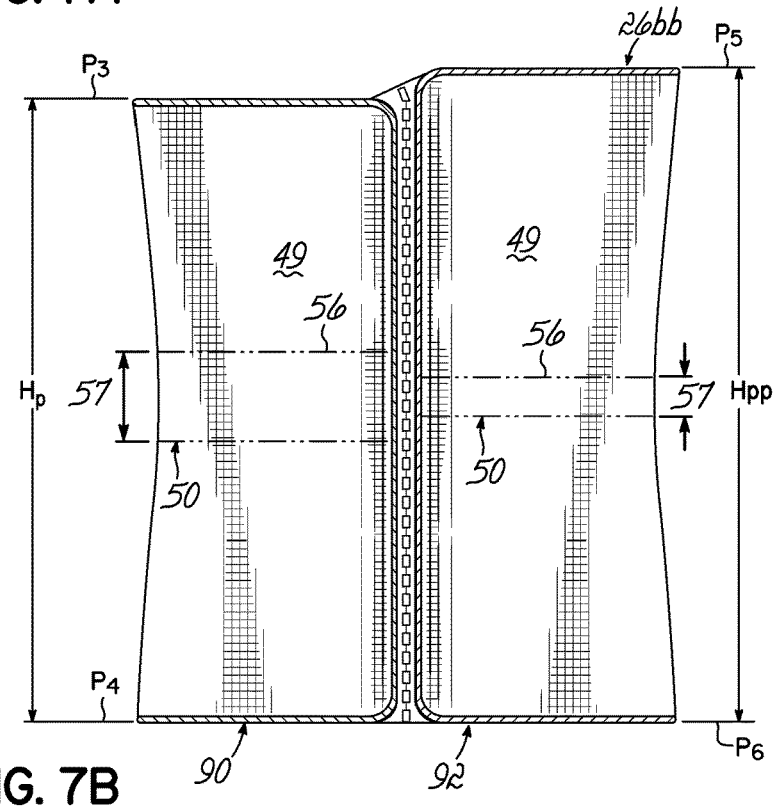
FIG. 7B is a cross-sectional view of the portion of the interior string of FIG. 6A showing two pockets of different sizes due to the location of the longitudinal seams of the pockets before the springs of FIG. 6A are inserted in the pockets.

This concept is shown in FIGS. 7A and 7B. FIG. 7B shows one of the longitudinal seams 50 of one of the outer pockets 90 below the longitudinal seam 50 of adjacent inner pocket 92 of an interior string 26*bb*. Thus, the preloaded outer pockets 90 are smaller in size than the preloaded inner pockets 92 of interior strings 26*bb*. More particularly, the height $H_p$ of the preloaded outer pockets 90 is smaller in size than the height $H_{pp}$ of the preloaded inner pockets 92 of interior strings 26*bb*. As shown in FIG. 7A, when the heavy and core springs 78, 62, for example, are inserted into the outer and inner pockets 90, 92, respectively, the loaded outer and inner pockets 90, 92 of interior strings 26*bb* expand to a height H, larger than either of the heights $H_p$, $H_{pp}$ of the preloaded outer and inner pockets 90, 92, respectively.

Figure 10D:
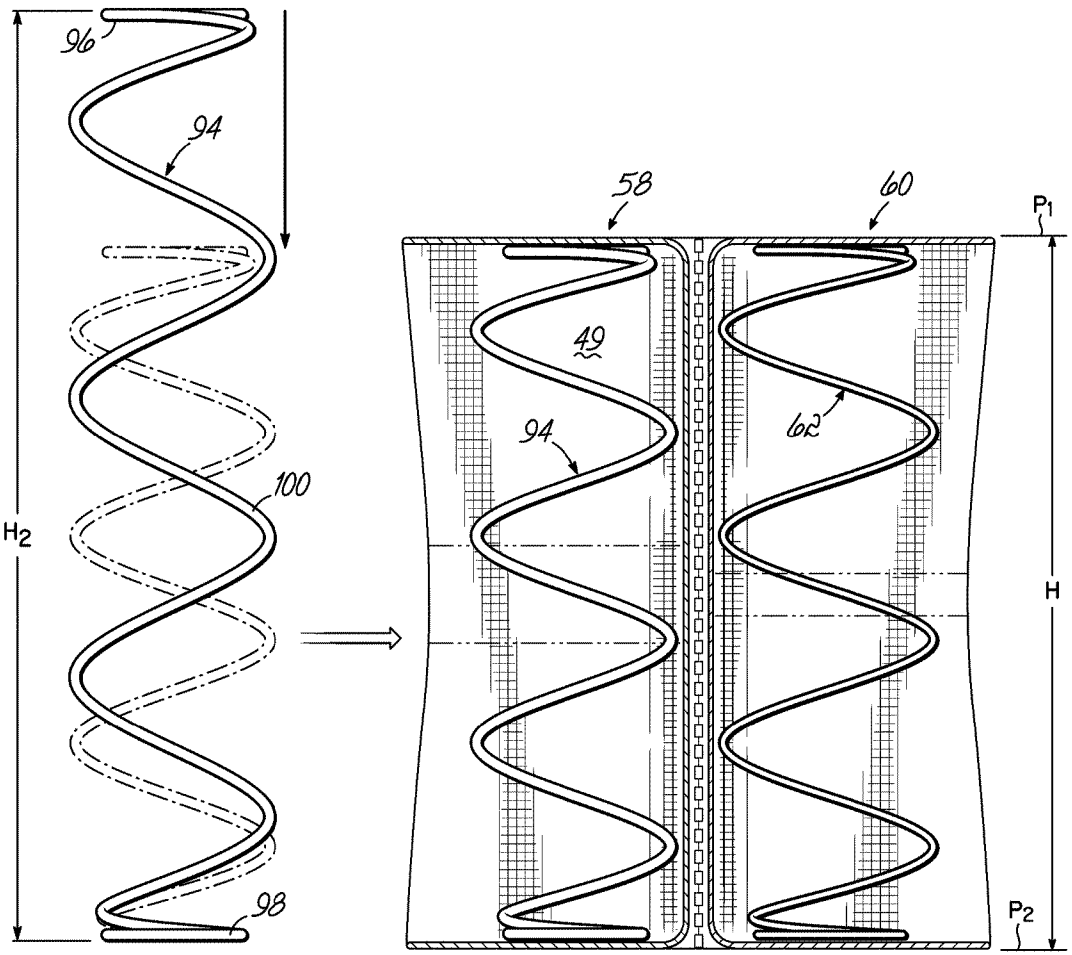
FIG. 10D is a side elevational view of a heavy tall spring being compressed and pocketed.

FIGS. 8 and 9 illustrate other springs in an out-of-pocket condition which may be used in firm pockets having a greater firmness than the pockets containing compressed core springs 62. For example, FIG. 8 shows a "heavy tall" coil spring 94 having an out-of-pocket height "$H_2$". As best shown in FIG. 8, each heavy tall spring 94 has a central or longitudinal axis A4, an upper end turn 96, a lower end turn 98 and a plurality of central convolutions 100 between the end turns. Heavy tall spring 94 has a barrel-shape in which the diameter of the end turns 96, 98 is less than the diameter of the central convolutions 100. As shown in FIG. 8, at least one of the central convolutions 100 has an out-of-pocket barrel diameter $D_1$ greater than the out-of-pocket diameters of the other convolutions of the heavy tall spring 94. As best shown in FIG. 8, each barrel-shaped heavy tall spring 94 is symmetrical, having a center or middle portion 102 and two identical end portions 104. Upon being compressed and inserted into one of the pockets of one of the external strings shown herein or one of the outer pockets 58 of one of the interior strings shown herein, the barrel diameter $D_1$ of heavy tall spring 94 shown in FIG. 8 expands or increases while the height decreases, as shown in FIG. 10D. Again, although symmetrical barrel-shaped springs are shown in the drawings, the present invention may be used with any shapes of springs such as springs having a uniform diameter or non-symmetrical shape.

Figure 10E:
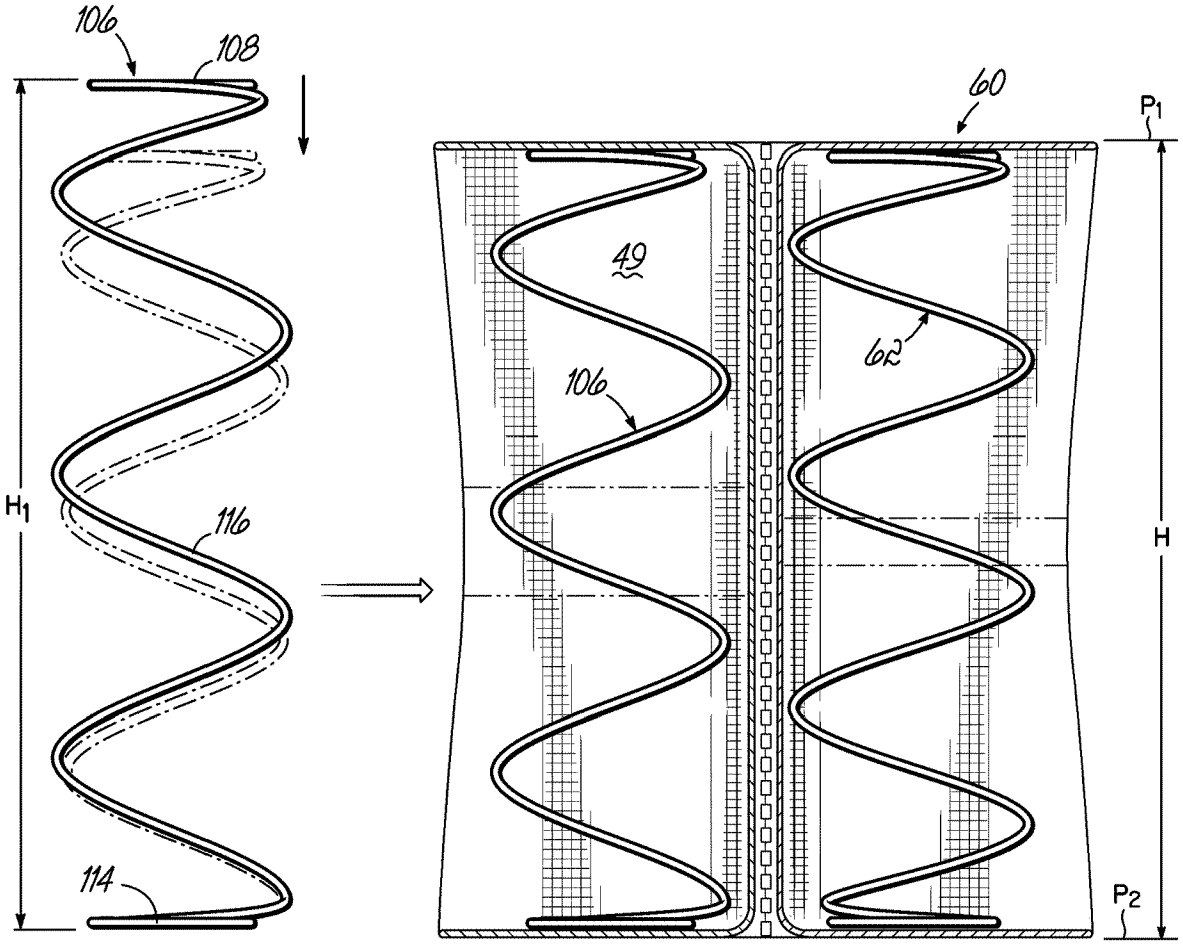
FIG. 10E is a side elevational view of a stiff spring being compressed and pocketed.

FIG. 9 shows two different springs which may be pocketed inside a shorter pocket due to their increased force compared to core springs. FIG. 9 shows a "stiff" coil spring 106 having an out-of-pocket height "$H_1$". As best shown in FIG. 9, each stiff spring 106 has a central or longitudinal axis A5, an upper end turn 108, a lower end turn 114 and a plurality of central convolutions 116 between the end turns. Stiff spring 106 has a barrel-shape in which the diameter of the end turns 108, 114 is less than the diameter of the central convolutions 116. As shown in FIG. 9, at least one of the central convolutions 116 has an out-of-pocket barrel diameter $D_1$ greater than the out-of-pocket diameters of the other convolutions of the stiff spring 106. As best shown in FIG. 9, each barrel-shaped stiff spring 106 is symmetrical, having a center or middle portion 118 and two identical end portions 120. Upon being compressed and inserted into one of the pockets of one of the external strings shown herein or one of the outer pockets of one of the interior strings shown herein, the barrel diameter $D_1$ of stiff spring 106 expands or increases while the height decreases, as shown in FIG. 10E. The number of convolutions of stiff spring 106 is less than the number of convolutions of core spring 62 of FIG. 8, thus illustrating the concept than by narrowing the number of convolutions of a coil spring the firmness of the coil spring when pocketed may be increased, all other spring properties of the two coil springs being equivalent.

Figure 10F:
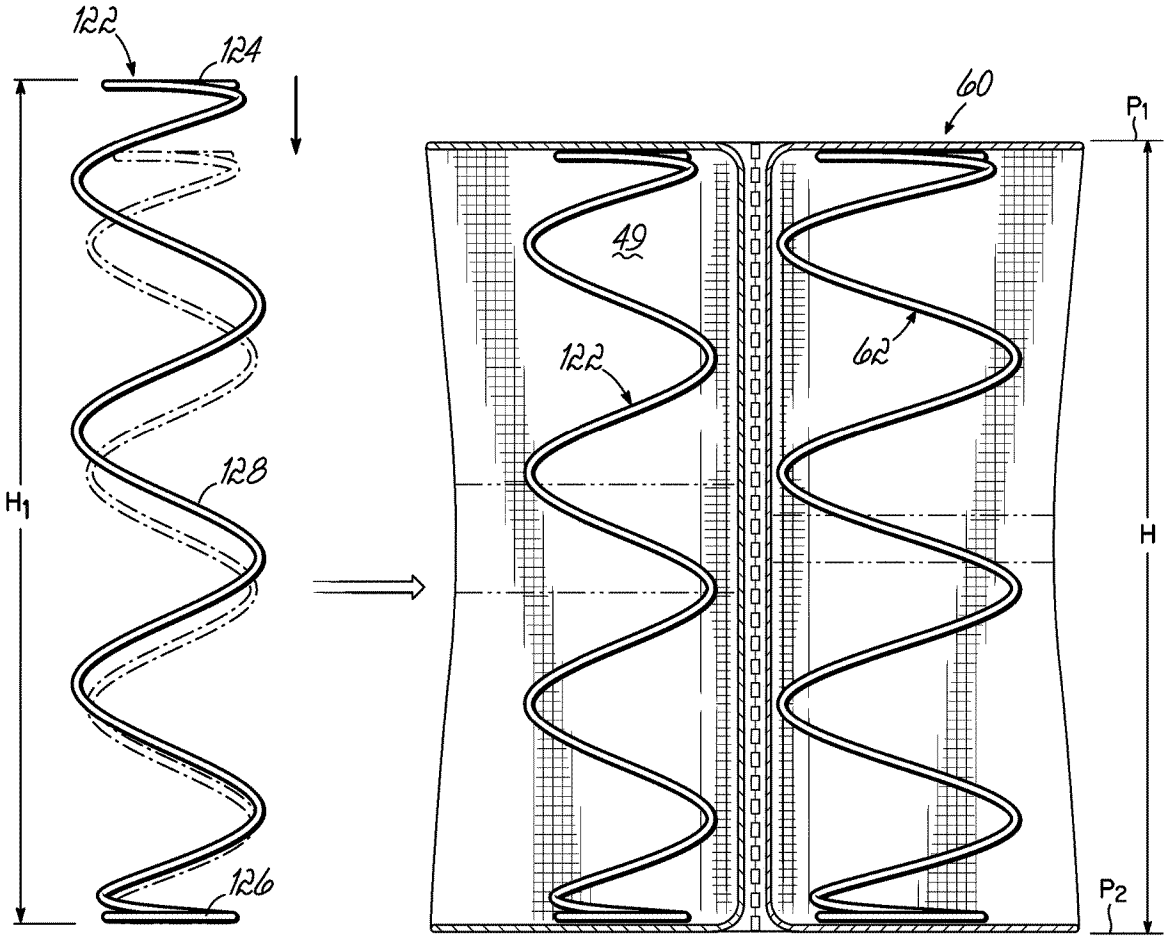
FIG. 10F is a side elevational view of a narrow spring being compressed and pocketed.

FIG. 9 further shows a "narrow" coil spring 122 having an out-of-pocket height "$H_1$". As best shown in FIG. 9, each narrow spring 122 has a central or longitudinal axis A6, an upper end turn 124, a lower end turn 126 and a plurality of central convolutions 128 between the end turns. Narrow spring 122 has a barrel-shape in which the diameter of the end turns 124, 126 is less than the diameter of the central convolutions 128. As shown in FIG. 9, at least one of the central convolutions 128 has an out-of-pocket barrel diameter $D_3$ greater than the out-of-pocket diameters of the other convolutions of the narrow spring 122. As best shown in FIG. 9, each barrel-shaped narrow spring 122 is symmetrical, having a center or middle portion 130 and two identical end portions 132. Upon being compressed and inserted into one of the pockets of one of the external strings shown herein or one of the outer pockets of one of the interior strings shown herein, the barrel diameter $D_3$ of narrow spring 122 expands or increases while the height decreases, as shown in FIG. 10F. The out-of-pocket barrel diameter $D_3$ of narrow spring 122 is less than the out-of-pocket barrel diameter $D_1$ of core spring 62 of FIG. 8, thus illustrating the concept than by narrowing the out-of-pocket diameter of a coil spring the firmness of the coil spring when pocketed may be increased, all other spring properties of the two coil springs being equivalent.

As shown in FIG. 8 and described above, the wire gauge of heavy spring 78 is less than the wire gauge of core spring 62, thus illustrating the concept than by thickening the wire or increasing the wire gauge of a coil spring the firmness of the coil spring when pocketed may be increased, all other spring properties of the two coil springs being equivalent.

As shown in FIG. 8 and described above, the out-of-pocket height of tall spring 36 is greater than the out-of-pocket height of core spring 62, thus illustrating the concept than by increasing the out-of-pocket height of a coil spring the firmness of the coil spring when pocketed may be increased, all other spring properties of the two coil springs being equivalent.

Although FIGS. 8 and 9 illustrate coil springs which show different spring properties which may increase the firmness of a pocketed spring, more than one of these properties may be combined in coil springs which are intended to be firmer than other coil springs. For example, the heavy tall coil spring 94 shown in FIG. 8 combines the properties of increased out-of-pocket height and heavier wire to create a firmer pocketed spring than core spring 62.

Although the concept of increasing the firmness of coil springs has been described relative to core springs 62, other springs may be used as the softer springs in a spring assembly. For example, heavy springs 78 may be used as the softer springs relative to heavy tall springs 94 due to the difference in out-of-pocket height of the two different coil springs, all other spring properties being equal. As another example, tall springs 36 may be used as the softer springs relative to heavy tall springs 94 due to the difference in wire thickness or wire gauge of the two different coil springs, all other spring properties being equal.

In any of the embodiments shown and described herein, the dimensions given are merely examples and not intended to be limiting. This includes the dimensions given for the barrel diameter, out-of-pocket height, in-pocket height and number of convolutions of any of the springs.

Although the pocketed springs have been described herein as barrel-shaped springs, it is within the scope of the invention described herein that the springs be cylindrical, an hour-glass shape of some other shape. Likewise, the pocketed springs need not be symmetrical, but may be any desired known configuration.

Figure 11:
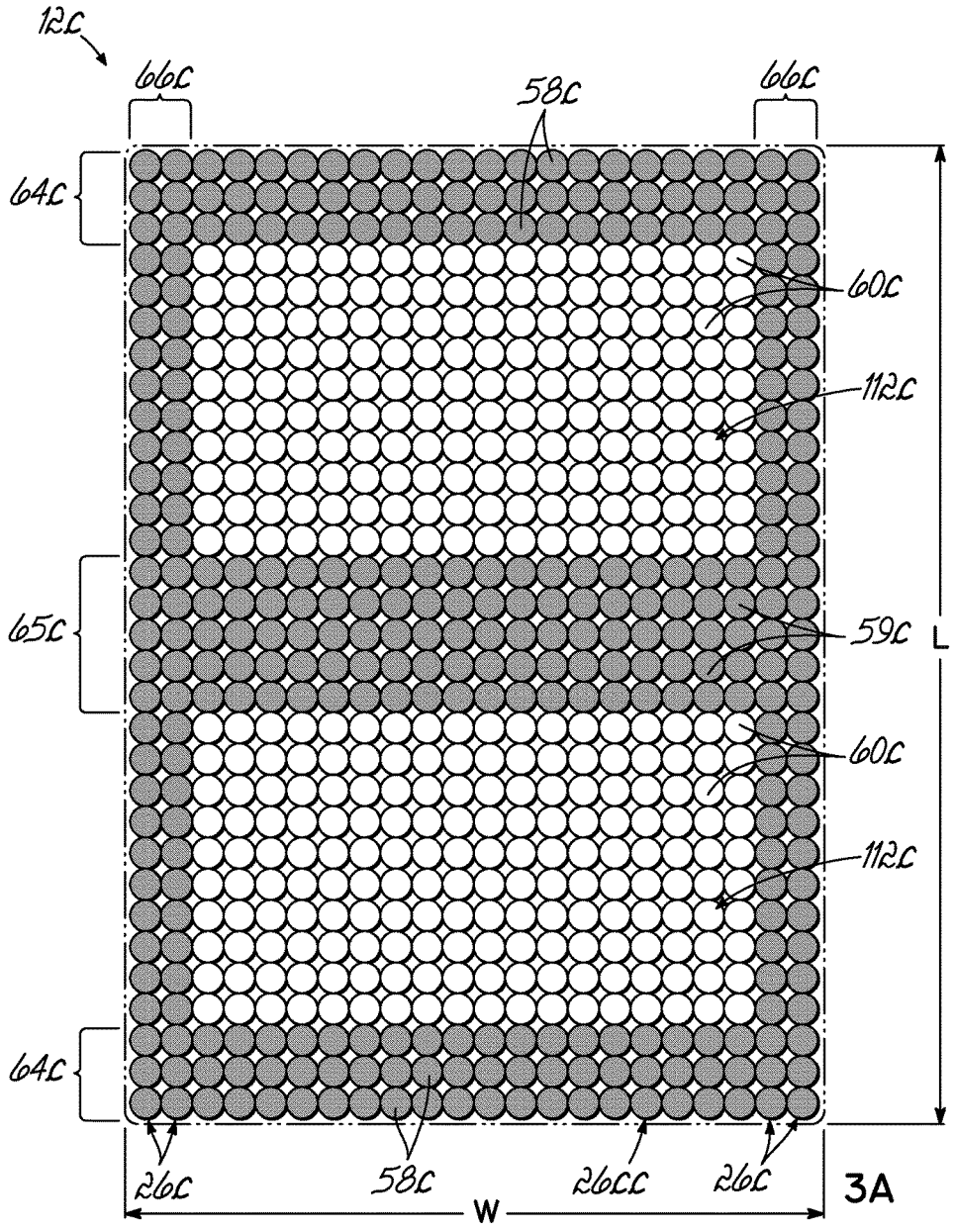
FIG. 11 is a top view of an alternative embodiment of pocketed spring assembly.

FIG. 11 illustrates another embodiment of pocketed spring assembly 12*c*. Pocketed spring assembly 12*c* is manufactured from exterior and interior strings 26*c*, 26*cc* of pocketed springs, respectively, joined together. Each string of pocketed springs 26*c*, 26*cc* extends longitudinally or from head-to-foot along the full length of the assembly 12*c*. The pockets of exterior strings 26*c* are illustrated in FIG. 11 being shaded, thus illustrating firmer pockets than the pockets of the white interior pockets of the interior strings 26*cc*.

As shown in FIG. 11, pocketed spring assembly 12*c* has opposite end sections 64*c* and a middle section 65*c* made up of pocketed springs. The end sections 64*c*, side sections 66*c* and middle section 65*c*, each containing pocketed springs make up a picture-frame shape of edge support which provides increased stiffness around the perimeter of the pocketed spring assembly 12 and across the back of a user. The end sections 64*c*, side sections 66*c* and middle section 65*c* have firmer pockets than the pockets of the white interior pockets of the interior strings 26*cc*.

Each of the interior strings 26*cc* of pocketed spring assembly 12*c* is identical and comprises three outer pockets

58*c* on each end and three middle pockets 59*c*, each containing a pocketed spring. Between the outer pockets 58*c* and middle pockets 59*c* are inner pockets 60*c*, each inner pocket 60*c* containing at least one spring. Instead of one core section 112, like in pocketed spring assembly 12, pocketed spring assembly 12*c* has two core sections 112*c* on opposite sides of the middle section 65*c*. Although FIG. 11 illustrates one middle section 65*c* of increased firmness for lumbar or back support, those skilled in the art will appreciate multiple sections of increased firmness may be incorporated into a pocketed spring assembly at any desired locations by modifying the composition of the interior strings of the pocketed spring assembly.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, foam resilient members may be used instead of coil springs. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly of approximately a uniform height, the pocketed spring assembly comprising a plurality of parallel strings of pocketed springs, each of said strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams, wherein at least some of the pockets of some of the strings are different sizes when empty due to different linear distances between the longitudinal seams and aligned free edges of the pockets, the pockets being approximately the same height with springs therein due, at least in part, to different properties of the springs;

cushioning materials; and a cover encasing the pocketed spring assembly and cushioning materials.

2. A bedding or seating product comprising:

a pocketed spring assembly of approximately a uniform height, the pocketed spring assembly comprising a plurality of parallel strings of pocketed springs, each of said strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams, wherein at least some of the pockets of some of the strings are different sizes when empty due to different linear distances between the longitudinal seams and aligned free edges of the pockets, the pockets being approximately the same height with springs therein due, at least in part, to different properties of the springs.

3. The product of claim 2 wherein the pocketed spring assembly has interior and exterior strings, the pockets of the exterior strings containing the same springs, at least some of the pockets of the interior strings containing springs different than the springs of the pockets of the exterior springs.

4. The product of claim 2 wherein the springs are made of wire and the strings having different sizes when empty have pocketed springs of different firmness due, at least partially, to the gauge of the wire.

5. The product of claim 2 wherein each of the springs is made of the same gauge wire.

6. The product of claim 3 wherein the internal strings have pocketed springs of different firmness due, at least partially, to the diameter of the springs.

7. The product of claim 3 wherein the internal strings have pocketed springs of different firmness due, at least partially, to the out-of-pocket height of the springs.

8. A pocketed spring assembly for a bedding or seating product, said pocketed spring assembly comprising:

interior and exterior parallel strings of pocketed springs of approximately the same height, each of the strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams, wherein at least some of the pockets of the interior strings have different sizes when empty due to different locations of the longitudinal seams of the pockets of the interior strings, the pockets of the interior strings being approximately the same height with springs therein but of different firmness due, at least in part, to different properties of the pocketed springs and wherein the pockets of the interior strings being approximately the same size with springs therein due, at least in part, to the fabric.

9. The pocketed spring assembly of claim 8 wherein the springs within the exterior strings have the same properties.

10. The pocketed spring assembly of claim 8, the different firmness of the pocketed springs being due, at least partially, to different geometries of the springs.

11. The pocketed spring assembly of claim 8 wherein the pockets of the interior strings being approximately the same size with springs therein due, at least in part, to the gauge of the wire of the springs.

12. A pocketed spring assembly for a bedding or seating product, said pocketed spring assembly comprising:

a plurality of parallel strings of springs, each of said strings being joined to at least one adjacent string, each of said strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams;

wherein at least some of the strings contain pockets of different sizes without springs therein due to the location of the longitudinal seams of the pockets, first springs being inside small pockets and second springs being inside large pockets, thereby stretching the fabric of the small pockets to create a string having a generally uniform height and pocketed springs of different firmness.

13. The pocketed spring assembly of claim 12 wherein the pocketed spring assembly has four sides of edge support.

14. The pocketed spring assembly of claim 12 wherein the first springs are made of a lesser gauge wire than the second springs.

15. The pocketed spring assembly of claim 12 wherein the first springs have a greater out-of-pocket height than the second springs.

16. A string of pocketed springs for a pocketed spring assembly, said string of pocketed springs comprising:

a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams;

wherein said string has outer pockets and inner pockets between the outer pockets, the outer pockets being smaller than the inner pockets without springs therein, the inner and outer pockets being approximately the same size with springs therein.

17. The string of pocketed springs of claim 16 wherein the springs in the outer pockets have a greater out-of-pocket height than springs in the inner pockets.

18. The string of pocketed springs of claim 16 wherein the springs in the outer pockets are made of a lesser gauge wire than the springs in the inner pockets.

19. A string of pocketed springs for a pocketed spring assembly, said string of pocketed springs comprising:

a plurality of interconnected pockets, each of the pockets containing at least one spring encased in fabric, the fabric of each pocket being joined to itself along a longitudinal seam, adjacent pockets being separated by transverse seams, wherein the string has outer pockets and inner pockets between the outer pockets, the outer pockets being smaller than the inner pockets of the interior strings without springs therein due to placement of the longitudinal seams, the inner and outer pockets of the interior strings being approximately the same size with springs therein.

20. The string of pocketed springs of claim 19 wherein the springs in the outer pockets are made of a lesser gauge wire than the springs in the inner pockets.

21. The string of pocketed springs of claim 19 wherein the springs in the outer pockets have a greater out-of-pocket height than springs of the inner pockets.

22. The string of pocketed springs of claim 19 wherein the springs within the string are made of the same gauge wire.

* * * * *